United States Patent [19]

Bando

[11] Patent Number: 4,965,634

[45] Date of Patent: Oct. 23, 1990

[54] IMAGE RECORDING APPARATUS CAPABLE OF CONTROLLING IMAGE DENSITY

[75] Inventor: Toshiro Bando, Yokohama, Japan

[73] Assignee: Ricoh Company, Ltd., Tokyo, Japan

[21] Appl. No.: 437,515

[22] Filed: Nov. 16, 1989

[30] Foreign Application Priority Data

Nov. 18, 1988 [JP] Japan ..... 63-292200

[51] Int. Cl.[5] ..... G03G 15/08

[52] U.S. Cl. ..... 355/208; 355/203; 355/204; 355/246; 118/691; 118/712

[58] Field of Search ..... 355/203, 204, 208, 209, 355/246, 251, 229, 214; 118/645, 653, 691, 688, 665, 712; 430/120, 122

[56] References Cited

U.S. PATENT DOCUMENTS

| | | | |
|---|---|---|---|
| 4,200,391 | 4/1980 | Sakamoto et al. | 355/214 |
| 4,215,930 | 8/1980 | Miyakawa et al. | 355/208 |
| 4,313,671 | 2/1982 | Kuru | 355/214 |
| 4,348,099 | 9/1982 | Fantozzi | 355/208 |
| 4,372,674 | 2/1983 | Yukawa et al. | 355/208 |
| 4,466,731 | 8/1984 | Champion et al. | 355/246 |
| 4,575,224 | 3/1986 | Arnold | 355/203 |
| 4,831,410 | 5/1989 | Adams et al. | 355/208 |
| 4,837,600 | 6/1989 | Kasai et al. | 355/208 |

*Primary Examiner*—A. C. Prescott

*Attorney, Agent, or Firm*—Oblon, Spivak, McClelland, Maier & Neustadt

[57] ABSTRACT

An image recording apparatus for electrostatically forming a latent image representative of a document on a photoconductive element, or image carrier, and developing the latent image by a developer to produce a visible image. The apparatus is capable of controlling the density of an image to be recorded by adjusting the amount of illumination, toner density, bias voltage for development, etc. A target toner density is selected in response to the density of a toner image which is formed on the image carrier and has a relatively high density. The amount of illumination is adjusted in response to the density of a toner image also formed on the image carrier and having a relatively low density. Further, the bis voltage is selected on the basis of a ratio of the density of a reference density pattern and the actual density of a document.

4 Claims, 60 Drawing Sheets

| Fig.11B-1 | Fig.11B-2 | Fig.11B-3 |
|---|---|---|

| Fig.11C-1 | Fig.11C-2 | Fig.11C-3 |
|---|---|---|

| Fig.12B-1 |
| --- |
| Fig.12B-2 |

Fig.13A
Fig.13A-1 Fig.13A-2

Fig. 13A-1

| | 7 | 6 | 5 | 4 |
|---|---|---|---|---|
| 0 | AE MODE. | | | PAPER DISCHARGE |
| 1 | TRANSFER CLEANER RELEASE SOL⊖ | TRANSFER CLEANER RELEASE SOL⊕ | CHARGER CLEANER MOTOR REVERSE | CHARGER CLEANER MOTOR FORWARD |
| 2 | P SENSOR LED | LAMP 2 | LAMP 1 | TRANSFER CLEANER BIAS |
| | | | | |
| | | | | |
| 22 | | | | |

Fig. 13A-2

| | 3 | 2 | 1 | 0 |
|---|---|---|---|---|
| SERIAL DATA 1 | TRANSFER DISCHARGE DCO | TRANSFER DISCHARGE DC 1 | TRANSFER DISCHARGE $\overline{AC}$ / DC | TRANSFER DISCHARGE AC / $\overline{DC}$ |
| SERIAL DATA 2 | | TRANSFER CLAMP MOTOR | BACKUP ROLLER RELEASE SOL | PAPER CLAMP SOL |
| PARALLEL DATA | DRUM CLEANER BIAS | PRECLEANING DISCHARGE | PRETRANSFER DISCHARGE LAMP | MAIN CHARGE |
| | | | | |
| | | | | |
| GAIN SET MODE | | TONER SENSOR GAIN SET MODE | AE SENSOR GAIN SET MODE | P SENSOR GAIN SET MODE |

Fig. 13B

| BIT / BYTE | 7 | 6 | 5 | 4 | 3 | 2 | 1 | 0 |
|---|---|---|---|---|---|---|---|---|
| 0 | CHARGER CLEANER HOME | CONNEC BLACK & WHITE | CONNEC COLOR | THERMISTOR OUTAGE | OVERHEAT | RELOAD | ILLUMINATION ERROR | ILLUMINATING |
| | | | | | | | | |
| 10 | BL TONER DENSITY | | | | | | | |

CONTROL STATUS

| Fig.17-1 | Fig.17-2 |
|---|---|

Fig.17-2

| | |
|---|---|
| ZERO-CROSS INTERRUPT (INT1) | Fig.30 |
| LAMP TIMER INTERRUPT (INTT1) | Fig.34 |
| HEATER TIMER INTERRUPT (INTTO) | Fig.37 |
| INTERVAL TIMER INTERRUPT (INTE1) | Fig.38 |
| SERIAL RECEIVE INTERRUPT (INTSR) | Fig.35 |

Fig.32A-1

Fig.32A

| |
|---|
| Fig.32A-1 |
| Fig.32A-2 |

| | |
|---|---|
| SERIAL DATA 1 | RECEIVE BUFFER |
| SERIAL DATA 2 | |
| PARALLEL DATA | |
| SET Y TONER DENSITY | |
| SET M TONER DENSITY | |
| SET C TONER DENSITY | |
| SET BL TONER DENSITY | |
| SET LAMP VOLTAGE | |
| SET GRID VOLTAGE | |
| SET BIAS VOLTAGE | |
| SET TRANSFER VOLTAGE | |
| SET FIXING TEMPERATURE | |
| P SENSOR SET MODE FLAG | |
| 26° P SENSOR SET VALUE | |
| 120° P SENSOR SET VALUE | |
| AE SENSOR SET MODE FLAG | |
| AE SENSOR SET VALUE | |
| TONER SENSOR SET MODE FLAG | |
| BL SENSOR SET GAIN | |
| Y SENSOR SET GAIN | |
| M SENSOR SET GAIN | |
| C SENSOR SET GAIN | |
| GAIN SET MODE | |
| | |
| RECEIVE ADDRESS COUNTER | |
| | |
| | |

Fig.32A-2

| | |
|---|---|
| | |
| CONTROL STATUS | TRANSMIT BUFFER |
| SENSED FIXING TEMPERATURE | |
| SENSED PATTERN DENSITY | |
| SENSED DOCUMENT DENSITY | |
| SENSED Y TONER DENSITY | |
| SENSED M TONER DENSITY | |
| SENSED C TONER DENSITY | |
| SENSED BL TONER DENSITY | |
| 26° P SENSOR GAIN | |
| 120° P SENSOR GAIN | |
| AE SENSOR GAIN | |
| | |
| TRANSMIT ADDRESS COUNTER | |
| | |

Fig.32B

| |
|---|
| Fig.32B-1 |
| Fig.32B-2 |

Fig.32B-1

| | |
|---|---|
| FREQUENCY DETECT FLAG | FREQUENCY DETECT |
| 60 Hz FLAG | |
| | |
| LAMP VOLTAGE SAMPLING FLAG | LAMP CONTROL |
| SOFT START FLAG | |
| SOFT START INCREMENT | |
| SENSED LAMP VOLTAGE | |
| EFFECTIVE LAMP VOLTAGE | |
| TARGET LAMP VOLTAGE | |
| LAMP. PHASE ANGLE | |
| PROPORTION GAIN | |
| SAFETY TIMER | |
| LAMP ON VOLTAGE THRESHOLD | |
| | |
| FIXING TEMPERATURE SAMPLING FLAG | HEATER CONTROL |
| SENSED FIXING TEMP. 1 | |
| SENSED FIXING TEMP. 2 | |
| TARGET FIXING TEMP. | |
| HEATER PHASE ANGLE | |
| PROPORTION GAIN | |
| INTEGRATION GAIN | |
| OVERHEAT THRESHOLD | |
| THERMISTOR OUTAGE THRESHOLD | |
| RELOAD THRESHOLD | |
| | |

Fig. 32B-2

| | |
|---|---|
| GRID VOLTAGE SAMPLING FLAG | GRID CONTROL |
| SENSED GRID VOLTAGE 1 | |
| SENSED GRID VOLTAGE 2 | |
| TARGET GRID VOLTAGE | |
| PWM TIMER PULSE WIDTH | |
| PROPORTION GAIN | |
| INTEGRATION GAIN | |
| SAMPLING TIMER 5 (MS) | |
| | |
| BIAS VOLTAGE SAMPLING FLAG | BIAS CONTROL |
| SENSED BIAS VOLTAGE 1 | |
| SENSED BIAS VOLTAGE 2 | |
| TARGET BIAS VOLTAGE | |
| PWM TIMER PULSE WIDTH | |
| PROPORTION GAIN | |
| INTEGRATION GAIN | |
| | |
| | |

Fig.32C-1

Fig.32C

| |
|---|
| Fig.32C-1 |
| Fig.32C-2 |

| | |
|---|---|
| TONER CONTROL START FLAG | |
| TONER SUPPLY SOL PERIOD COUNTER | |
| SENSED BL TONER DENSITY 1 | BL TONER |
| SENSED BL TONER DENSITY 2 | |
| TARGET BL TONER DENSITY | |
| BL TONER SUPPLY SOL PWM COUNTER | |
| BL TONER PROPORTION GAIN | |
| BL TONER INTEGRATION GAIN | |
| SENSED Y TONER DENSITY 1 | Y TONER |
| SENSED Y TONER DENSITY 2 | |
| TARGET Y TONER DENSITY | |
| Y TONER SUPPLY SOL PWM COUNTER | |
| Y TONER PROPORTION GAIN | |
| Y TONER INTEGRATION GAIN | |
| SENSED Y TONER DENSITY 1 | M TONER |
| SENSED M TONER DENSITY 2 | |
| TARGET M TONER DENSITY | |
| M TONER SUPPLY SOL PWM COUNTER | |
| M TONER PROPORTION GAIN | |
| M TONER INTEGRATION GAIN | |
| SENSED C TONER DENSITY 1 | C TONER |
| SENSED C TONER DENSITY 2 | |
| TARGET C TONER DENSITY | |
| C TONER SUPPLY SOL PWM COUNTER | |
| C TONER PROPORTION GAIN | |
| C TONER INTEGRATION GAIN | |
| PWM COUNTER CLOCK (50MS) | |

| Fig.39-1 | Fig.39-2 |
|---|---|

IMAGE RECORDING APPARATUS CAPABLE OF CONTROLLING IMAGE DENSITY

BACKGROUND OF THE INVENTION

The present invention relates to an image recording apparatus which electrostatically forms a latent image representative of a document image on a photoconductive element, or image carrier, and develops the latent image by a toner or similar developer for producing a visible image. More particularly, the present invention is concerned with an image recording apparatus capable of controlling image density by adjusting the amount of illumination, toner density, bias voltage for development, etc.

An electrophotographic copier, facsimile machine, laser printer or similar image recording apparatus performs a sequence of image forming steps such as a charging step, an exposing step and a developing step. A change in the image forming condition in any of such steps effects the density of an image to be recorded by the apparatus. Various approaches have heretofore been proposed to control image density and thereby to maintain image quality constant. Typical of the prior art approaches uses an exclusive pattern having a reference density and provided in a particular area of a document image reading surface which is adjacent to an effective reading area. When the reference density pattern is illuminated, a reflection therefrom is projected onto a photoconductive element to electrostatically form a latent image. The latent image is developed to produce a toner image. A reflection type photosensor senses the density of the toner image in terms of reflectance. The amount of toner supply is adjusted on the basis of the sensed density to thereby control the toner concentration of in developer which is composed of the toner and a carrier, whereby the density of an image to be recorded by the apparatus is controlled. This kind of approach allows the actual instantaneous density of the toner image to be detected because the sensed density of the toner image reflects the conditions of all the elements joining in the charging, exposing, developing and other image forming processes. However, when the amount of illumination is somewhat larger than expected or when the charge potential on the photoconductive element is excessively low, the toner supply is so adjusted as to increase the toner concentration in the developer even if the toner concentration is adequate, resulting in an excessive toner concentration in the developer. Stated another way, while this prior art scheme is capable of controlling image density simply by adjusting the toner concentration in the developer, the control is apt to become unstable and causes image quality to fluctuate noticeably.

SUMMARY OF THE INVENTION

It is therefore an object of the present invention to provide an image recording apparatus capable of performing stable control for maintaining the density of images to be recorded constant.

It is another object of the present invention to provide a generally improved image recording apparatus.

An image recording apparatus capable of controlling image density of the present invention comprises an image carrier, a charger for charging the image carrier, illuminating optics for illuminating a document laid in an image reading area of a glass platen to electrostatically form a latent image representative of the document on the image carrier, a developing unit for developing the latent image formed on the image carrier to produce a visible image, a reference density pattern having a reference density positioned in close proximity to the image reading area, a read image density sensor for sensing a density of the reference density pattern and a density of the document, a recorded image density sensor located to face a surface of the image carrier for sensing an image density of a recorded image having been developed by the developing unit, and a control unit for automatically adjusts the amount of light issuing from the illuminating optics in response to a first recorded image density which is sensed by the recorded image density sensor and associated with an image portion of the reference density pattern having a relatively low density. The control unit automatically adjusts a target value of a density of a developer stored in the developing unit in response to a second recorded image density which is sensed by the recorded image density sensor and associated with a portion of the reference density pattern having a relatively high density. The control unit automatically adjusts a bias voltage to be applied to the developing unit in response to a ratio of a first read image density which is sensed by the read image density sensor and associated with the density of the reference density pattern and a second read image density which is sensed by the read image density sensor and associated with the density of the document.

BRIEF DESCRIPTION OF THE DRAWINGS

The above and other objects, features and advantages of the present invention will become more apparent from the following detailed description taken with the accompanying drawings in which:

FIGS. 13A and 13B are memory maps showing the assignment of a memory built in a microcomputer;

FIGS. 32A to 32D are memory maps showing the assignment of a memory built in a microcomputer;

DESCRIPTION OF THE PREFERRED EMBODIMENT

Figure 1:
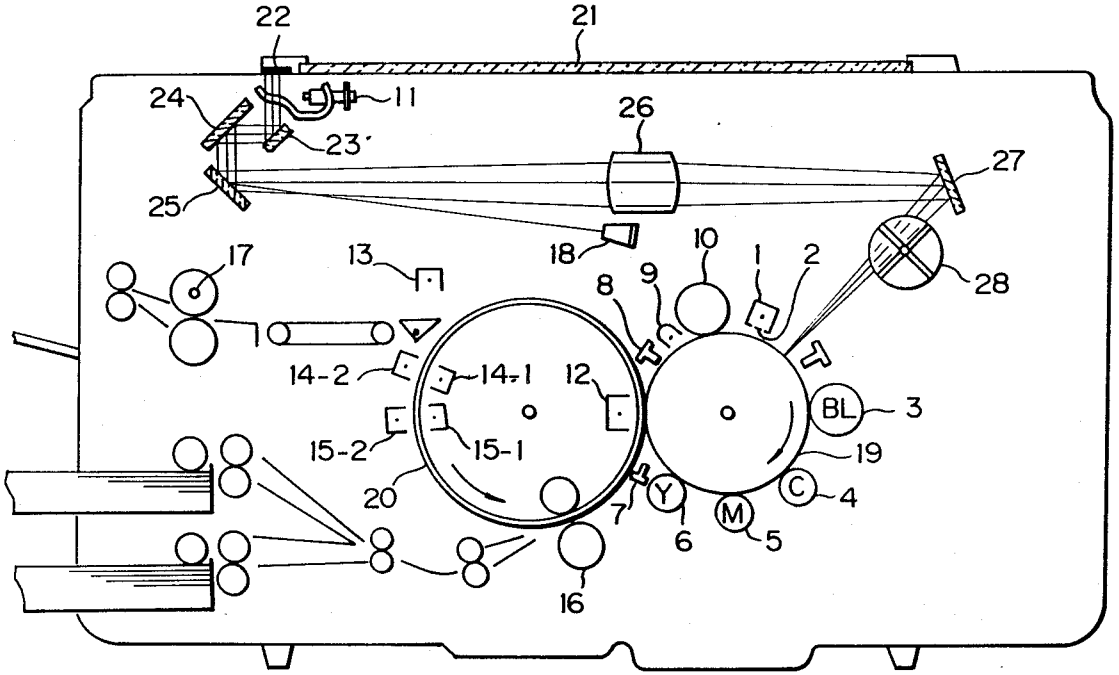
FIG. 1 is a sectional side elevation schematically showing a color copier belonging to a family of image recording apparatuses to which the present invention is applicable.

Referring to FIG. 1 of the drawings, a color copier which is a specific form of an image forming apparatus is shown and includes a photoconductive element in the form of a drum 19. Arranged around the drum 19 are a main charger 1, a black (B) developing unit 3, a cyan (C) developing unit 4, a magenta (M) developing unit 5, a yellow (Y) developing unit 6, a pretransfer discharging lamp 7, a transfer drum 20, a toner image density sensor (also referred to as a P sensor hereinafter) 8, a precleaning discharger 9, and a cleaning brush 10. A transfer charger 12, a paper discharger 13, transfer DC dischargers 14-1 and 14-2, transfer AC dischargers 15-1 and 15-2 and a transfer cleaning brush 16 are positioned in close proximity to the drum 20.

A glass platen 21 is mounted on the top of the copier which defines a document reading surface. A white reference density plate 22 has a predetermined reflectance over the entire surface thereof and is located in the vicinity of one end of the glass platen 21 which is the read start end of the document reading surface. The reference density plate 22 is used in the process control as a density reference, as will be described in detail. Optics is located below the document reading surface for scanning a document which is laid on the glass platen 21. Specifically, light issuing from a lamp 11 is reflected by the document on the glass platen 21, and the resulting reflection is steered by a first mirror 23, a second mirror 24, a third mirror 25, a lens 26, a fourth mirror 27 and a color filter 29 to be focused on the drum 19.

Figure 2:
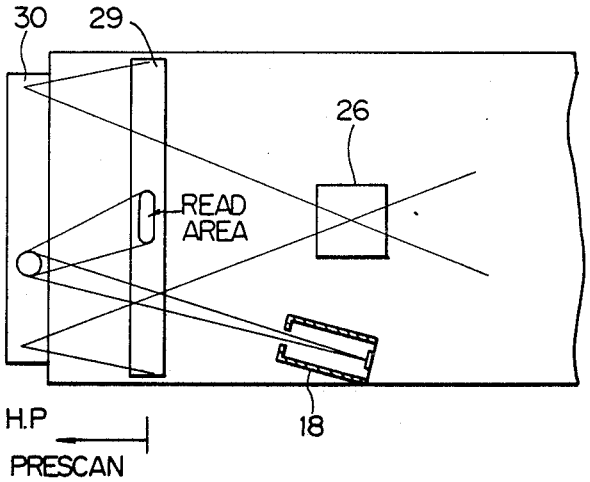
FIG. 2 is a plan view showing the arrangement of a document density sensor.

The optics has a document density sensor 18 responsive to the density of the document and that of the reference density plate 22. While the document density sensor 18 is shown as being located below the lens 26 in FIG. 1, this is merely for illustration. Specifically, as shown in FIG. 2, the sensor 18 is spaced apart from the lens 26 in the horizontal direction. The sensor 18, therefore, does not effect the image reading operation during copying operation and scans the document reading surface while receiving a reflection from the latter. Since both the reference density plate 22 and the document are located on the document reading surface, the sensor 18 senses their densities at the same time. In FIG. 2, a first carriage 29 is loaded with the lamp 11 and first mirror 23, while a second carriage 30 is loaded with the second and third mirrors 24 and 25. The first and second carriages 29 and 30 are mechanically driven in the right-and-left direction as viewed in FIG. 2 at a relative speed of 2:1. Specifically, when the optics is located at the left-hand side of FIG. 1, i.e., near its home position, the reading position is aligned with the reference density plate 22 so that the sensor 18 senses the density of the plate 22. As the scanning position is sequentially shifted to the right, the reading position is aligned with the document and, hence, the sensor 18 senses the density of the document.

Figure 3:
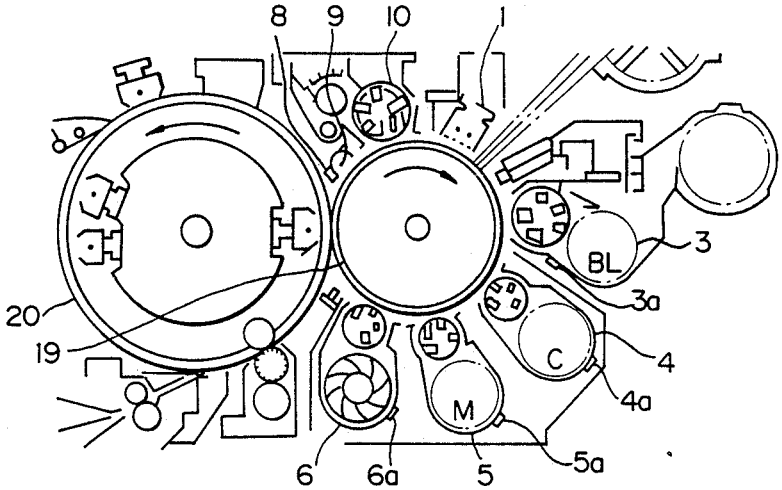
FIG. 3 is a fragmentary enlarged view of the copier shown in FIG. 1.
Figure 4A:
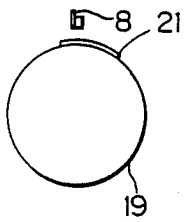
FIGS. 4A and 4B are views showing a positional relationship between a toner image density sensor (P sensor) and a photoconductive drum.
Figure 4B:
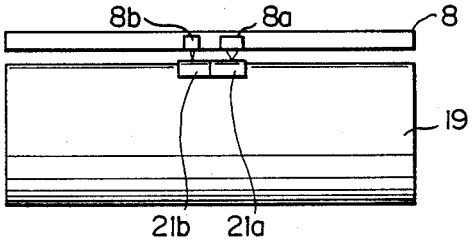
Figure 5A:
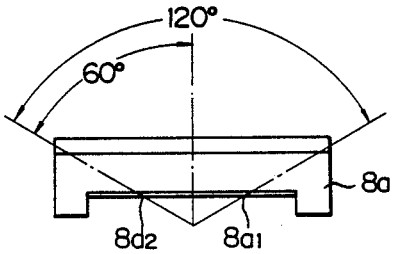
FIGS. 5A to 5C and 6A to 6C show the arrangement of photosensors which constitute a toner image density sensor.
Figure 6A:
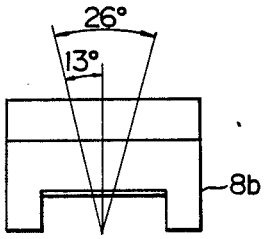
Figure 5B:
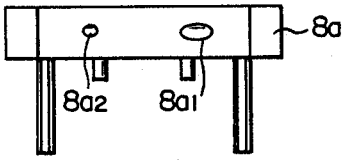
Figure 6B:
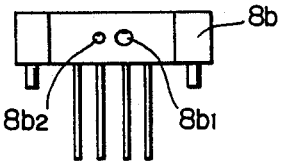
Figure 5C:
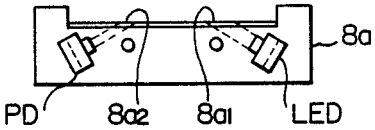
Figure 6C:
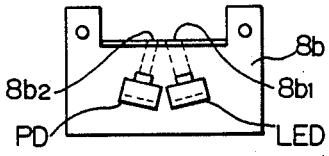

FIG. 3 shows an essential part of the copier in detail. As shown, toner density sensors (also referred to as F sensors hereinafter) 3*a*, 4*a*, 5*a* and 6*a* are respectively associated with the developing units 3, 4, 5 and 6 for sensing the toner concentrations or densities of developers stored in the latter. The sensors 3*a*, 4*a*, 5*a* and 6*a* each constitutes a transformer and senses a change in the permeability of the associated developer due to a change in toner density in terms of a change in the inductance of a transformer. The toner density sensor (P sensor) 8 is responsive to the reflectance of a toner image for measurement which will be formed in an exclusive area of the drum 19 which does not interfere with an image to be recorded. As shown in FIGS. 4A and 4B, the toner density sensor (P sensor) 8 in the illustrative embodiment is implemented by a pair of reflection type photosensors 8*a* and 8*b* which are arranged side by side at the intermediate between axially opposite ends of the drum 1. The photosensors 8*a* and 8*b* are used to sense respectively the density of a toner image 21*a* formed on the drum 19 and having a relatively low density and a toner image 21*b* also formed on the drum 19 and having a relatively high density.

The photosensors 8*a* and 8*b* are shown in detail in FIGS. 5A to 5C and 6A to 6C, respectively. As shown, each of the sensors 8*a* and 8*b* has a light emitting diode LED and a photodiode PD. The light emitting diode LED and photodiode PD of the sensor 8*a* have optical axes which are deviated by 120 degrees from each other, while those of the sensor 8*b* have optical axes which are deviated by 26 degrees. The sensos 8*a* and 8*b* have respectively windows $8a_1$ and $8b_1$ for sending light and windows $8a_2$ and $8b_2$ for receiving light. While both the photosensors 8*a* and 8*b* are arranged such that light issuing from the light emitting diode LED is reflected by a toner image and then incident to the associated photodiode PD, they are different from each other in the angle of incidence and the angle of reflection. Specifically, the photosensor 8*a* has a large angle of incidence and a large angle of reflection and, therefore, causes each toner particle to cast a shadow having a large area. Hence, even when the toner density has a relatively low concentration or density, the photosensor 8*a* is capable of sensing a change in toner density sensitively in terms of a change in the amount of reflection. However, when the toner density is relatively high, the sensitivity of the photosensor 8*a* to such a change is lowered. On the other hand, the photosensor 8*b* having a small angle of incidence and a small angle of reflection causes each toner particle to cast a shadow having a small area. The photosensor 8*b*, therefore, cannot sense toner density accurately if the toner image has a relatively low density, i.e., if the change in the amount of reflection from the toner image is small. Nevertheless, when the toner density is relatively high, the photosensor 8*b* is capable of sensing a change in toner density sensitively. For this reason, the photosensors 8*a* and 8*b* are used to sense a toner image having a low density and a toner image having a high density, respectively.

Figure 7A:
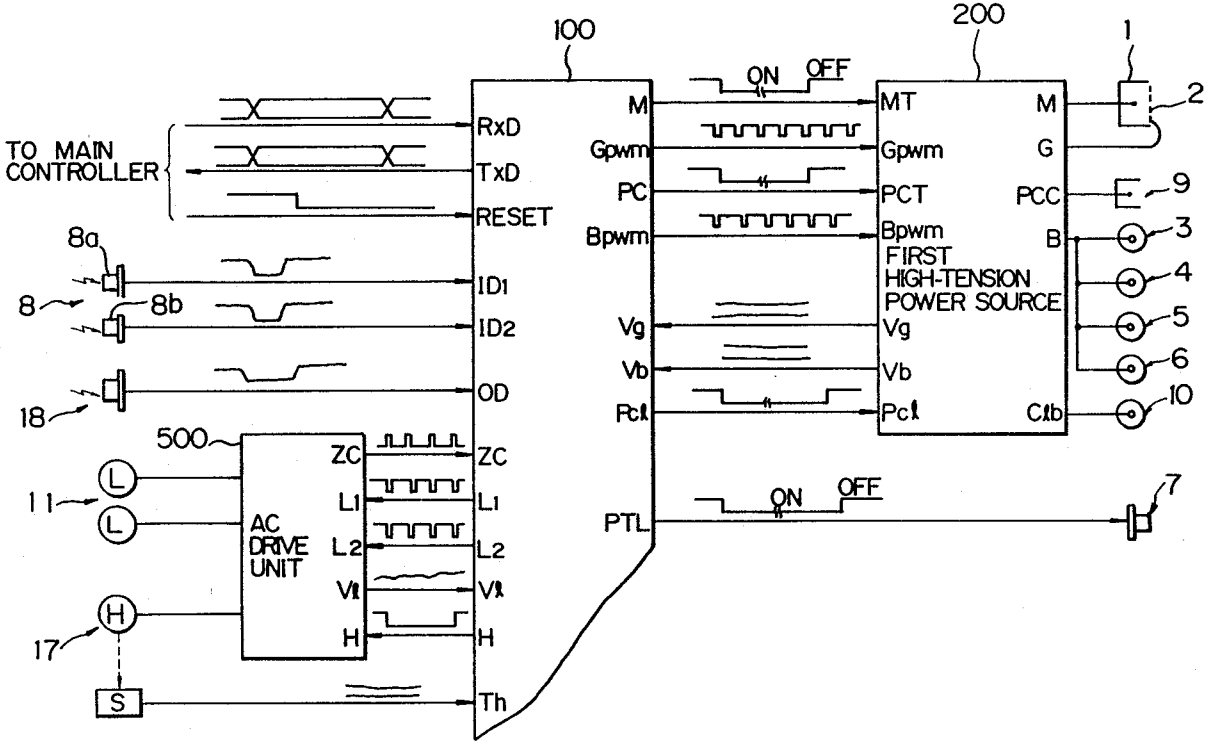
FIGS. 7A and 7B are schematic block diagrams showing a control circuit of the copier shown in FIG. 1 which includes a process controller and various components connected thereto.
Figure 7B:
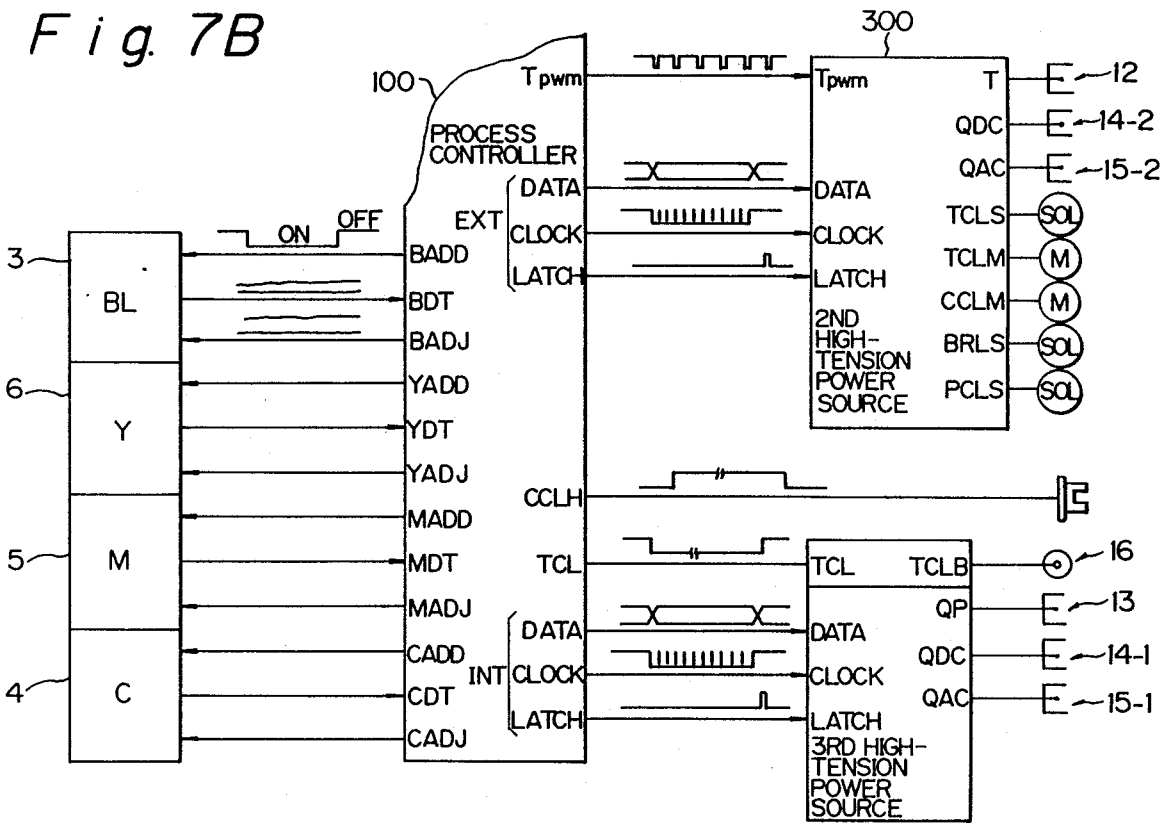

Referring to FIGS. 7A and 7B, the above-described control elements associated with the copying process are connected to a process controller 100. The loads 1, 3, 4, 5, 6, 9 and 10 are connected to the process controller 100 via a first high-tension power source 200. The main charger 1 has a grid 2 for a scorotron charger, and the grid 2 is also connected to the high-tension power source 200. The high-tension power source 200 has output terminals M, PCC and Clb. Outputs appearing on these terminals M, PCC and Clb are simply on-off controlled by trigger signals which are fed from the process controller 100. However, outputs appearing on output terminals G and B of the power source 200 are subjected to PWM (Pulse Width Modulation) control. Specifically, a voltage produced by boosting and rectifying a pulse width control signal Gpwm from the process controller 100 appears on the terminal G, and a part of this voltage is fed back to the process controller 100 via a terminal V*g*. A voltage produced by boosting and rectifying a pulse width control signal Bpwm also outputted by the process controller 100 appears on the terminal B, and a part of this voltage is fed back to the process controller 100 via a terminal V*b*. A second high-tension power source 300 controls and energizes the chargers 12, 14-1 and 15-2, a transfer cleaning solenoid (not shown) via an output terminal TCLS, a transfer cleaning motor (not shown) via a terminal TCLM, a charger cleaning motor (not shown) via a terminal CCLM, a back-up roller releasing solenoid (not shown) via a terminal BRLS, and a paper clamp solenoid (not shown) via a terminal PCLS.

A plurality of trigger signals are fed to the first high-tension power source 200 in parallel, while trigger signals other than a transfer output voltage setting input Tpwm are fed in series to the second high-tension power source 300. Specifically, the process controller 100 writes serial data DATA in a shift register, which will be described, of the second high-tension power source 300. In response to a latch pulse LATCH which appears at an adequate timing, the serial data are transformed into parallel data and fed out via output terminals QDC, QAC, . . . , PCLS. It is to be noted that in the second power source 300 the outputs T, QDC and QAC are controlled by beedback within the power source 300. A third high-tension power source 400 also receives trigger signals in parallel except for a transfer cleaning bias TCLB and operates in the same manner as the second high-tension power source 300.

Figure 8:
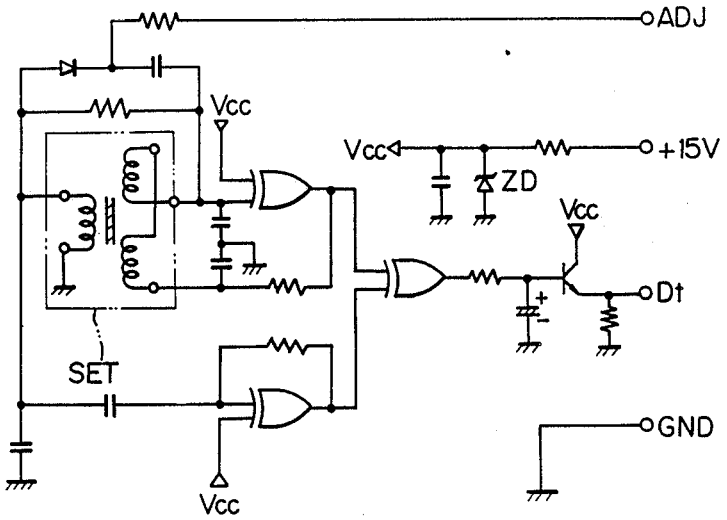
FIG. 8 is a circuit diagram showing a toner density sensor (F sensor) and circuitry associated therewith.

Toner density control associated with the developing units 3, 4, 5 and 6 is as follows. As shown in FIG. 7B, the developing units 3 to 6 have respectively toner supply inputs BADD, YADD, MADAD and CADD, toner density outputs BDT, YDT, MDT and CDT, and density adjustment inputs BADJ, YADJ, MADJ and CADJ. The process controller 100 controls the duties of the individual inputs ADDs such that the levels of the individual DTs coincide with the target densities assigned to the associated developing units. The developing units 3 to 6 are individually provided with a sense amplifier as shown in FIG. 8. The sense amplifier produces a DC signal representative of a density having been sensed by a toner density sensor SET (i.e. F sensor 3*a*, 4*a*, 5*a* or 6*a*) of the associated developing unit. The process controller 100 adjusts the sensitivity of the sense amplifiers in response to the DC signals appearing on the control terminals ADJ. An AC drive unit 500, FIG. 7A, energizes the lamp 11, a fixing heater 17 and other AC-driven loads which are shown in FIG. 1. The AC drive unit 500 has a zero-cross signal output ZC, lamp trigger inputs $L_1$ and $L_2$, a lamp voltage sense output V1, and a heater trigger input H. The process controller 100 controls the duties of $L_1$ and $L_2$ such that the sensed lamp voltage V1 equals a target voltage, while controlling the duty of H such that a fixing temperature sensed by a thermistor equals a target temperature.

Figure 9:
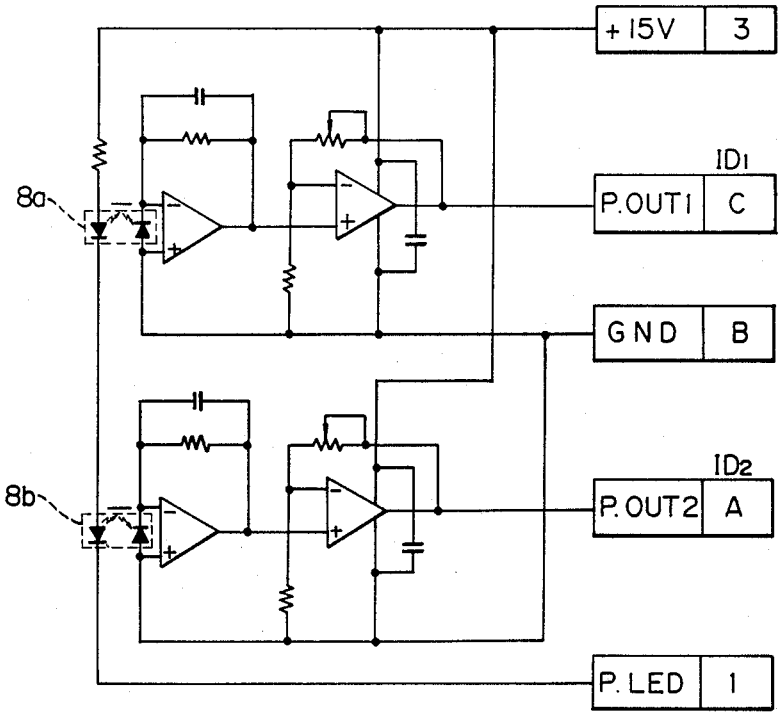
FIG. 9 is a circuit diagram showing the toner image density sensor (P sensor) and circuitry associated therewith.
Figure 10:
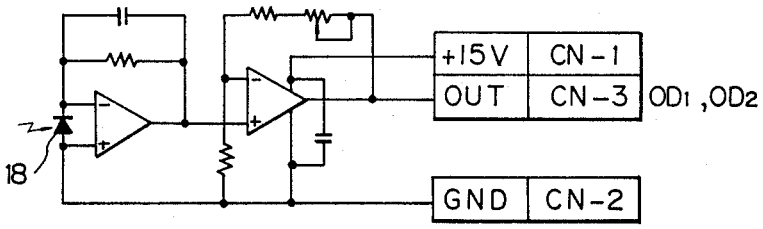
FIG. 10 is a circuit diagram showing a document density sensor and circuitry associated therewith.

The outputs of the toner image density sensor 8 are individually fed to input terminals $ID_1$ and $ID_2$ of the process controller 100. The output of the document density sensor 18 is applied to an input terminal OD of the process controller 100. The toner image density sensor 8 and the document density sensor 18 are constructed as shown in FIGS. 9 and 10, respectively. A shown in FIG. 7A, the process controller 100 forms an exclusive low density toner image and an exclusive high density image for measurement, FIGS. 4A and 4B, in an area of the drum 19 other than an effective recording area, receives an output of the photosensor 8*a* responsive to the former via the input terminal $ID_1$, and receives an output of the photosensor 8*b* responsive to the latter via the input terminal $ID_2$. The low density toner image is produced by developing by the developing unit a latent image having been formed on the drum 19 by illuminating the reference density plate 22. On the other hand, the high density toner image is produced by passing through the developing unit a latent image formed on the drum 19 having been charged by the main charger without illumination being effected. When the optics reaches a scanning position aligned with the reference density plate 22, the process controller 100 reads the instantaneous signal appearing on the input terminal OD and uses it as a reference pattern density $OD_1$. Further, when the scanning position is aligned with the document, the process controller 100 reads the signal on the input terminal OD and uses it as a document density $OD_2$. The data read by the process controller 100 are transferred to a main controller (not shown) via a serial transmission output TxD. The main controller in turn transfers data for energizing the individual loads and target data to a serial receive input RxD of the process controller 100. Waveforms depicted near the individual signal lines are representative of signals appearing thereon.

Figures 1, 11A:
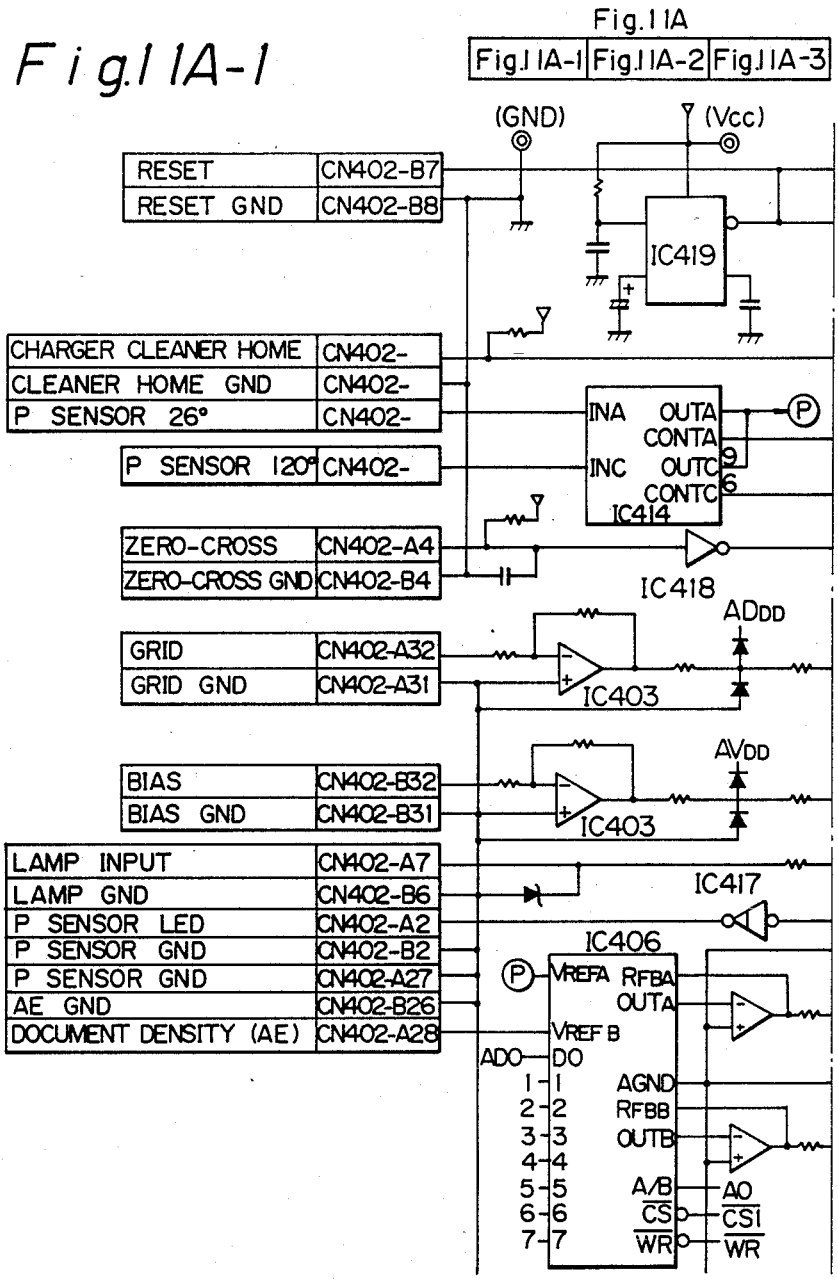
FIGS. 11A to 11C are block diagrams showing, when combined, the process control unit in detail.
Figures 2, 11A:
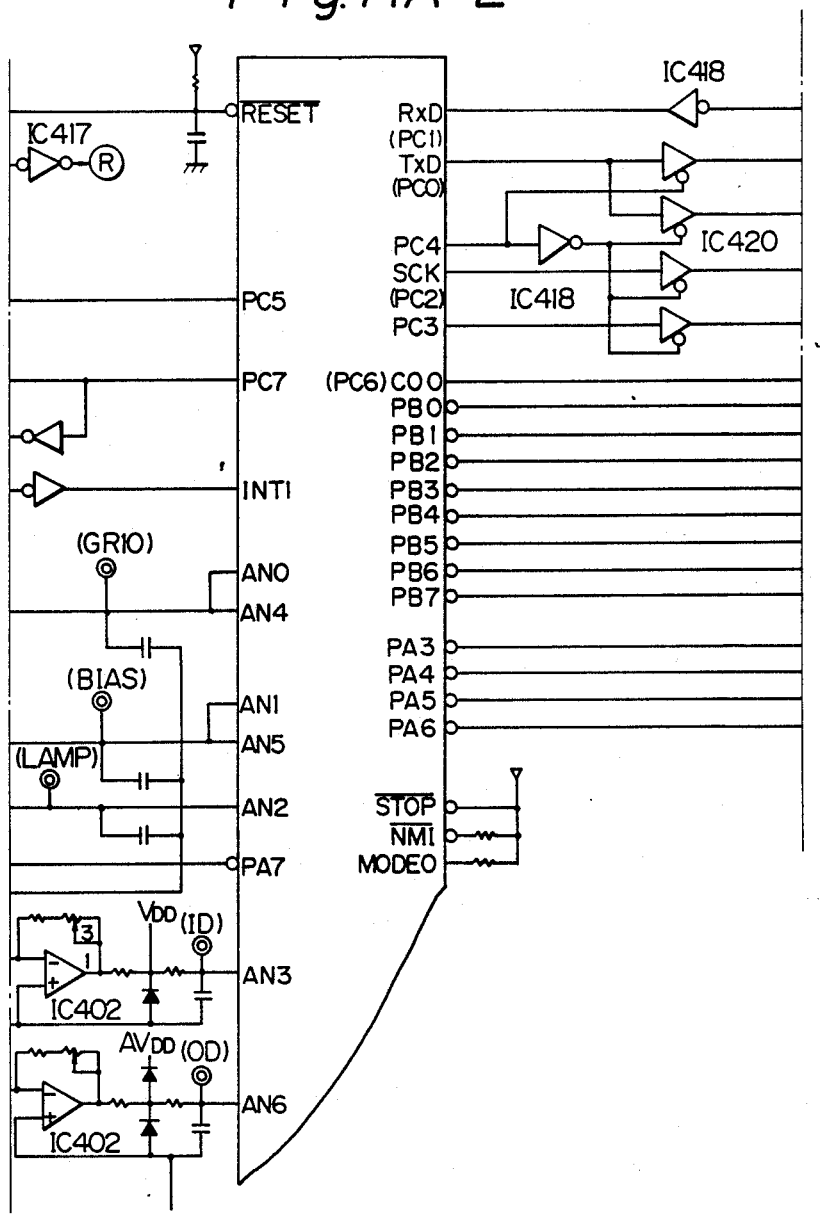
Figures 3, 11A:
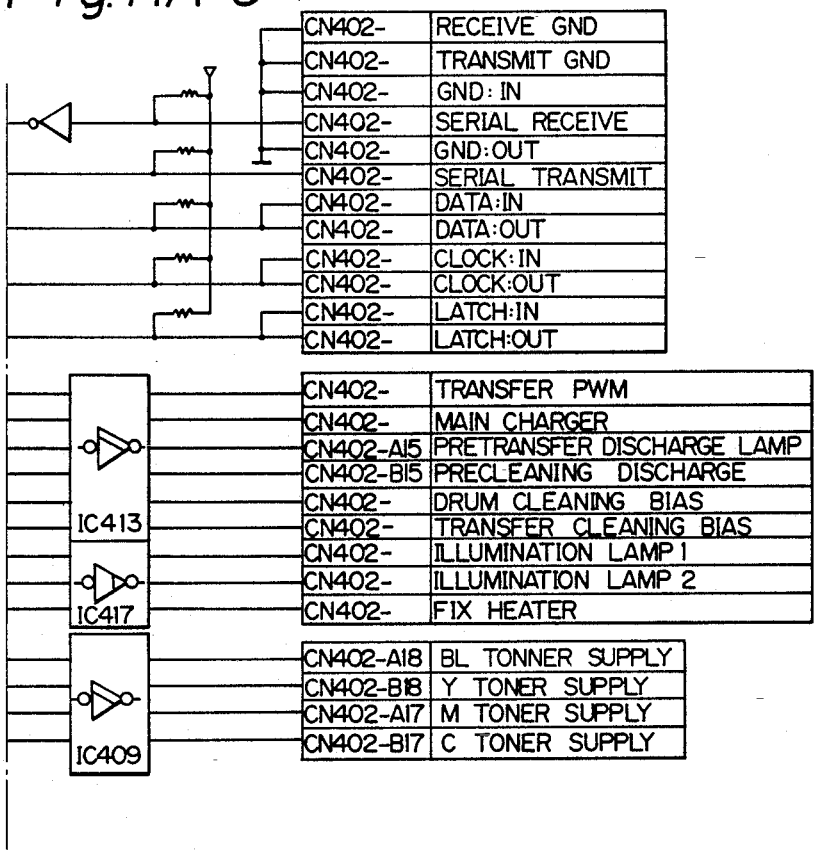
Figures 1, 11B:
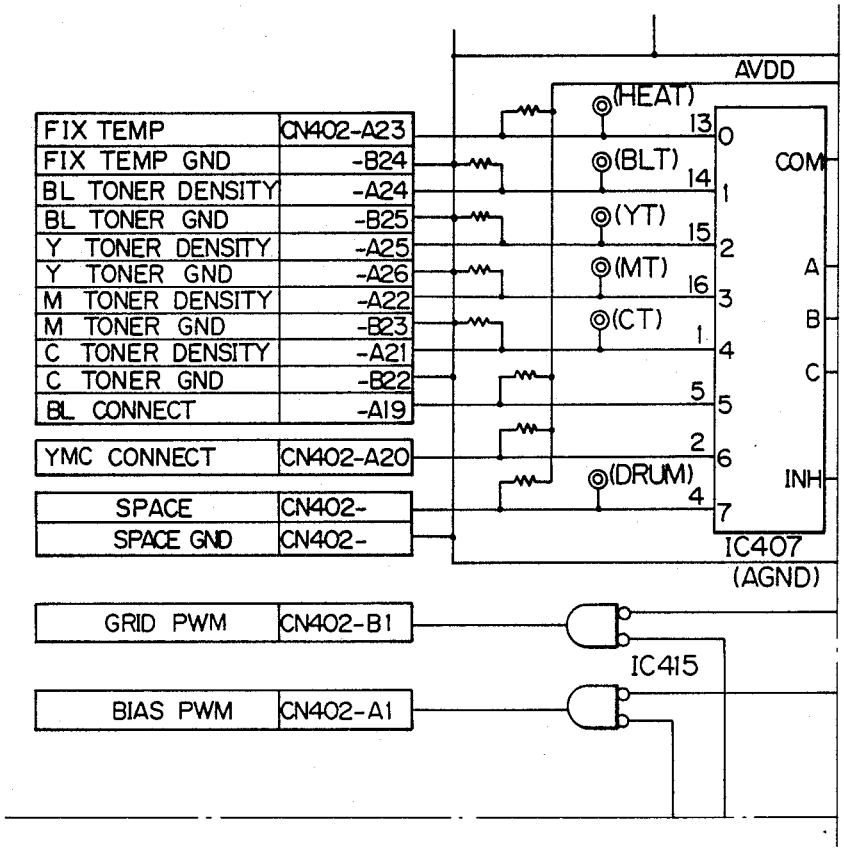
Figures 2, 11B:
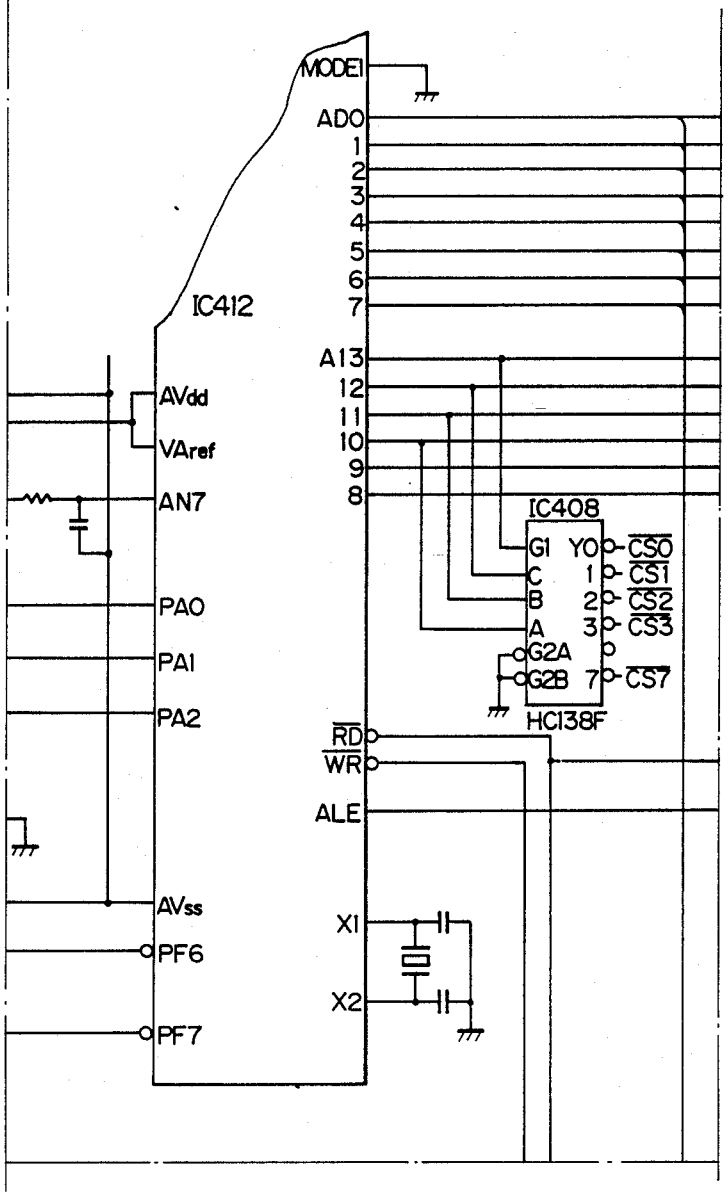
Figures 3, 11B:
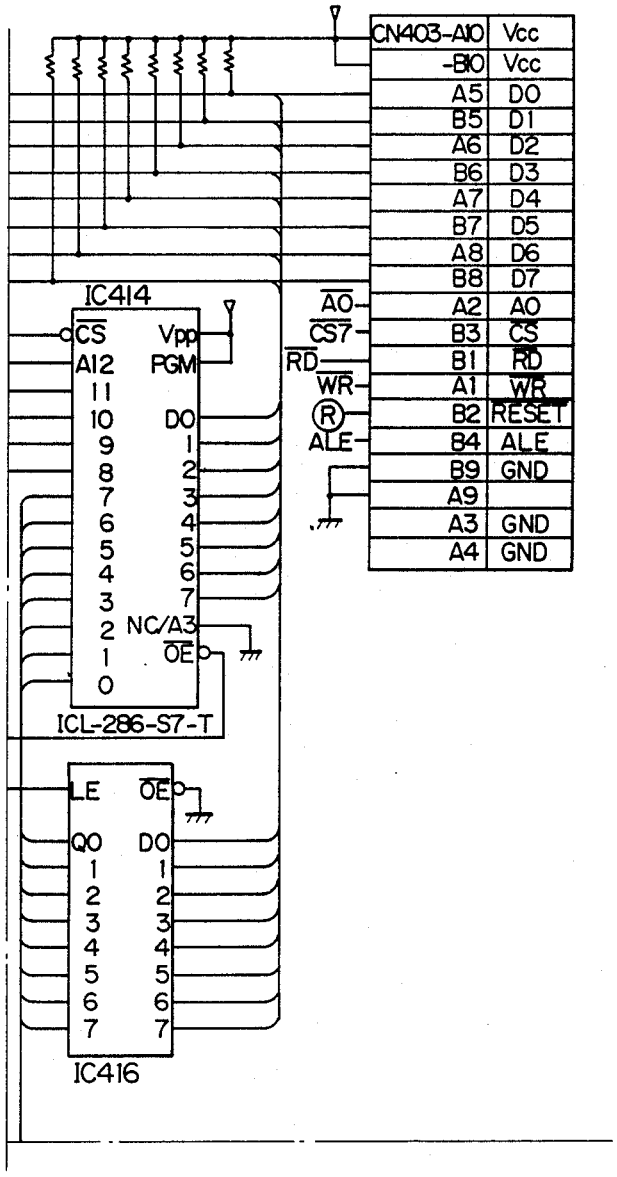
Figures 1, 11C:
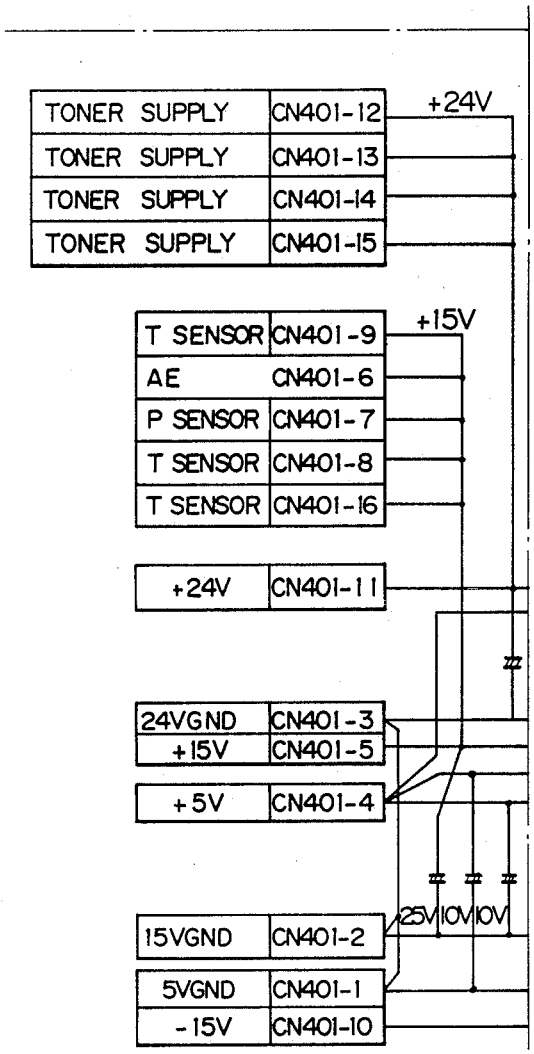
Figures 2, 11C:
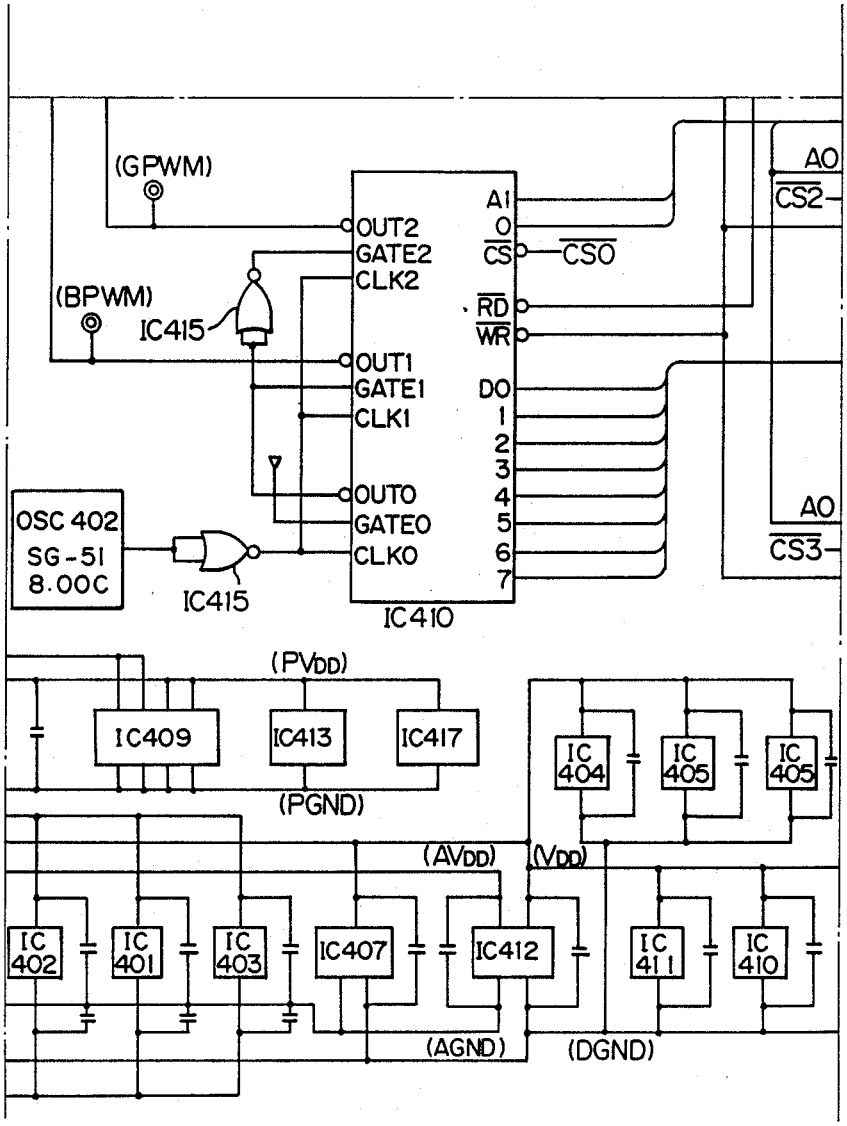
Figures 3, 11C:
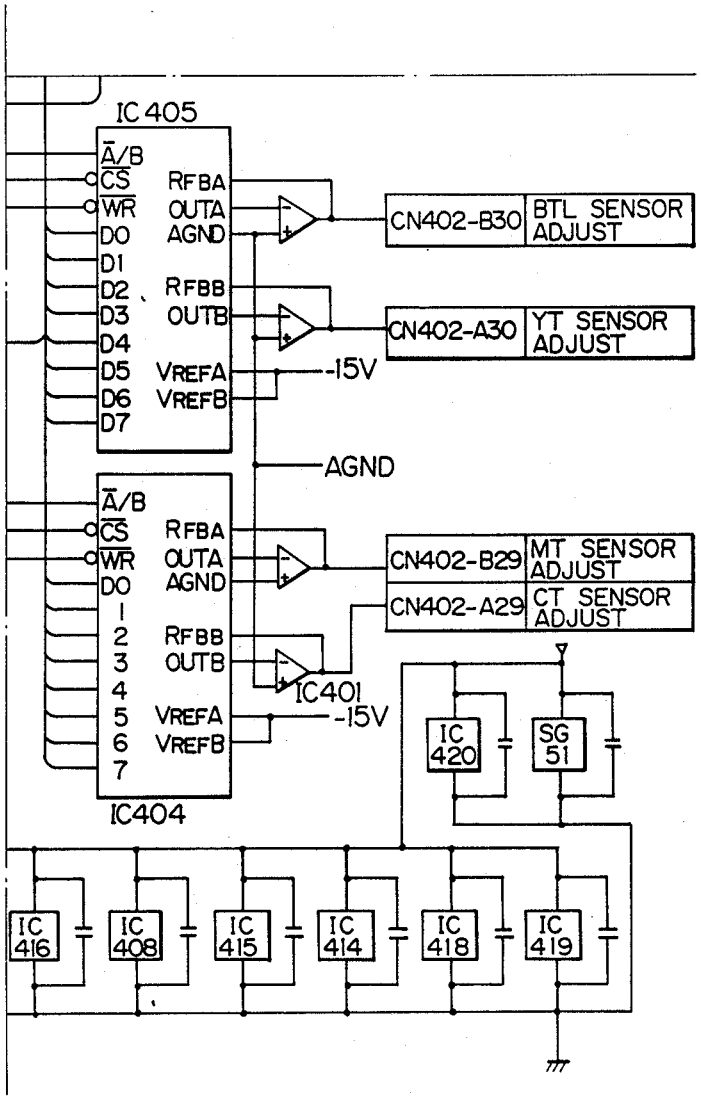

Referring to FIGS. 11A, 11B and 11C, a specific construction of the process controller 100 is shown in three segments. Joining the three segments along the broken lines of FIGS. 11A and 11C with those of FIG. 11B will show the entire process controller 110. As shown, the process controller 100 has a microcomputer IC412, a ROM IC411, a timer/counter IC410, and multiplication type digital-to-analog (DA) converters IC404, IC405 and IC406. Major terminals of the microcomputer IC412 function and are interfaced to the outside as will be described hereinafter.

The serial transmit and receive terminals TxD and RxD, respectively, are used to interchange data with the main controller, not shown. The transmit terminal TxD also functions to deliver serial data to various loads around the transfer drum. Specifically, when a port PC4 is in a low level or "L", a transmit output to the main controller appears on the terminal TxD while, when it is in a high level or "H", serial data output to the loads around the transfer drum appears. Outputs SCK and PC3 are adapted to output a serial data transfer clock and a serial data latch signal, respectively. A PWM pulse for setting a transfer current is fed via an output CO0. Trigger signals for the man charger, pretransfer discharge lamp, precleaning discharger, drum cleaner bias, transfer cleaner bias, lamp 1, lamp 2 and fixing heater are delivered via outputs PB0 to PB7, respectively. Outputs PA3 to PA6 are adapted to control toner supply solenoids each being associated with respective one of the B, Y, C and M developing units. Lower address/data buses AD0 to AD7 and upper address buses A8 to A13 are provided. A read signal, a write signal an an address latch signal are fed out via outputs RD, WR and ALE, respectively. A boosting circuit (not shown) generates a grid voltage and a bias voltage, while signals for controlling the passage of PWM signals to the boosting circuit are delivered via outputs PF6 and PF7. Specifically, the PWM signals for adjusting the grid voltage and bias voltage are delivered to output terminals OUT2 and OUT2 of the timer/-counter IC410.

The microcomputer IC412 has an AD converter therein so that analog voltages appearing on analog input ports AN0 to AN7 may be converted into digital amounts. The ports AN0 and AN4 are assigned to the detection of a grid voltage, the ports AN1 and AN5 are assigned to the detection of a bias voltage, the port AN2 is assigned to the detection of a lamp voltage, the port AND3 is assigned to the detection of a toner sensor, and the port AN 6 is assigned to the detection of a document density (AE). Eight different kinds of signals are selectively applied to the port AN7 by an analog multiplexer IC407. Specifically, three-bit select inputs A, B and C of the analog multiplexer IC407 are variable from 0,0,0 to 1,1,1 to selectively apply to the port AN7 signals representative of a fixing temperature (thermistor output), B developing unit toner density, Y developing unit toner density, M developing unit toner density, C developing unit toner density, connection of a color developing unit (YMC), and spare input. There are further provided an AD converter power source terminal AVdd, a reference voltage terminal VAref, and an analog ground terminals AVss. The toner image density signal and the document density signal applied to the ports AN3 and AN6 can be adjusted in level by the microcomputer IC412 itself by using a programmable gain amplifier which is constituted by the multiplication type DA converter IC406 and an operational amplifier IC402. Therefore, the input levels on the ports AN3 and AN6 are individually maintained constant with respect to a predetermined toner image density and a predetermined document density, with no regard to the scattering in the sensitivity of toner image density sensor and document density sensor. Concerning the toner image density sensor or P sensor 8, either one of the the outputs of the two photosensors 8*a* and 8*b* is selected by an analog switch IC414. The microcomputer IC412 controls the analog witch IC414 by an output thereof which appears on an output port PC7. An output signal for turning on the LEDs of the P sensor 8 is fed out via a port PA7. An input INT1 is a zero-cross interrupt input associated with the AC power source and used to control the phases of the illuminating lamp and fixing heater. There is further provided a power ON reset input RESET.

Figures 1, 12A:
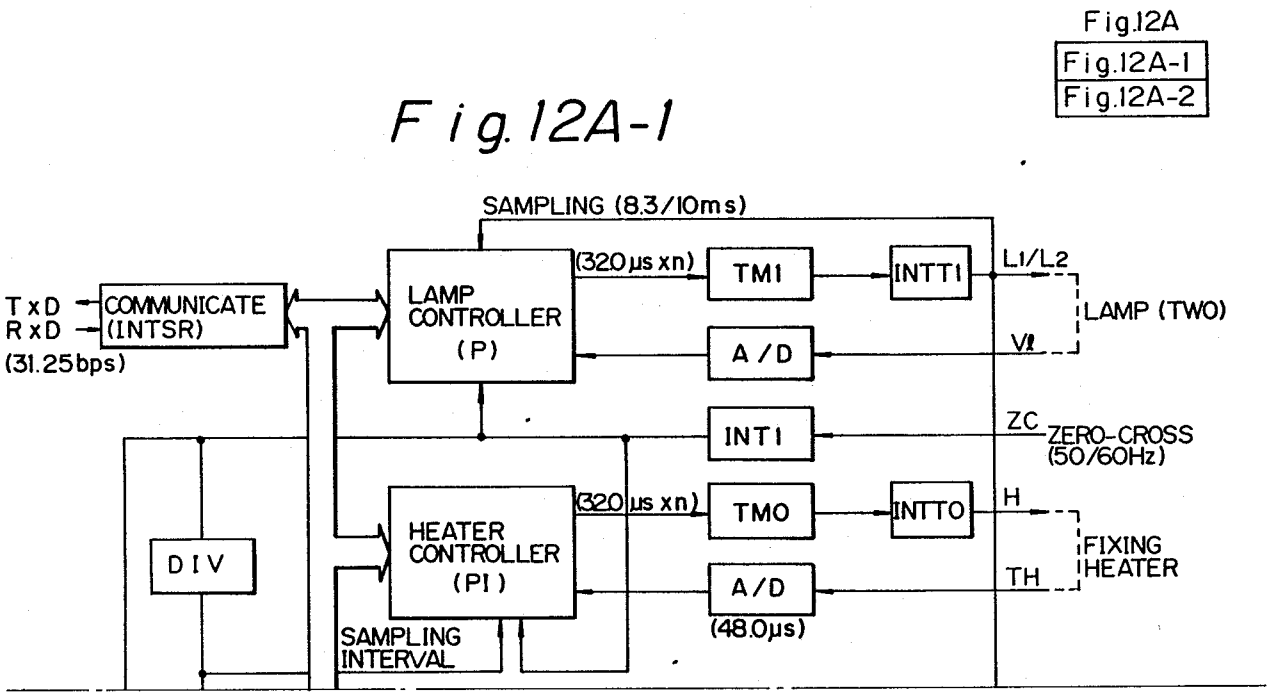
FIGS. 12A and 12B are schematic block diagrams representative of the functions of the process control unit.
Figures 2, 12A:
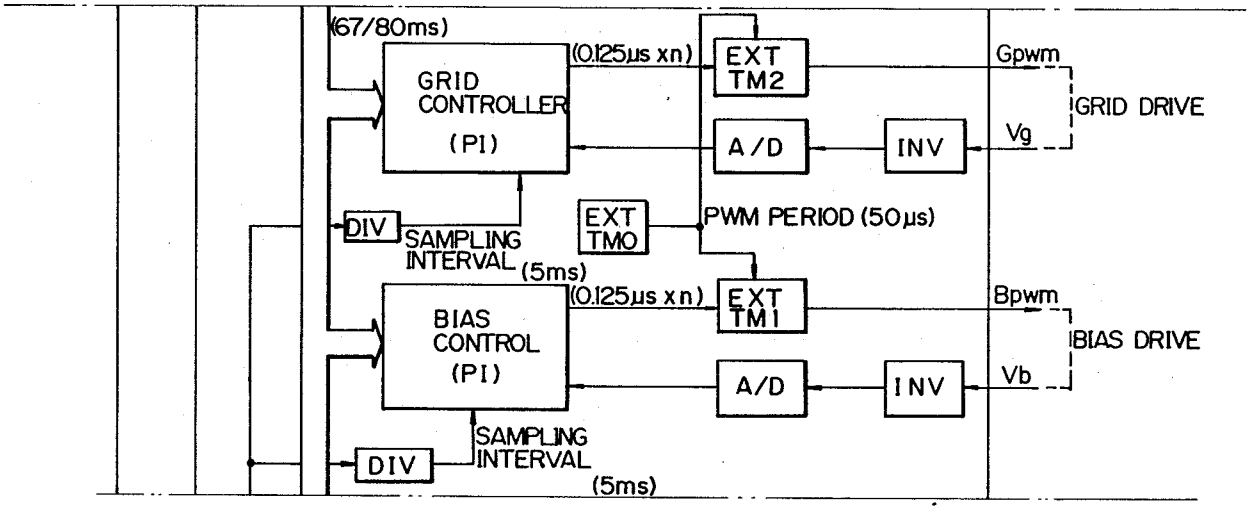
Figures 1, 12B:
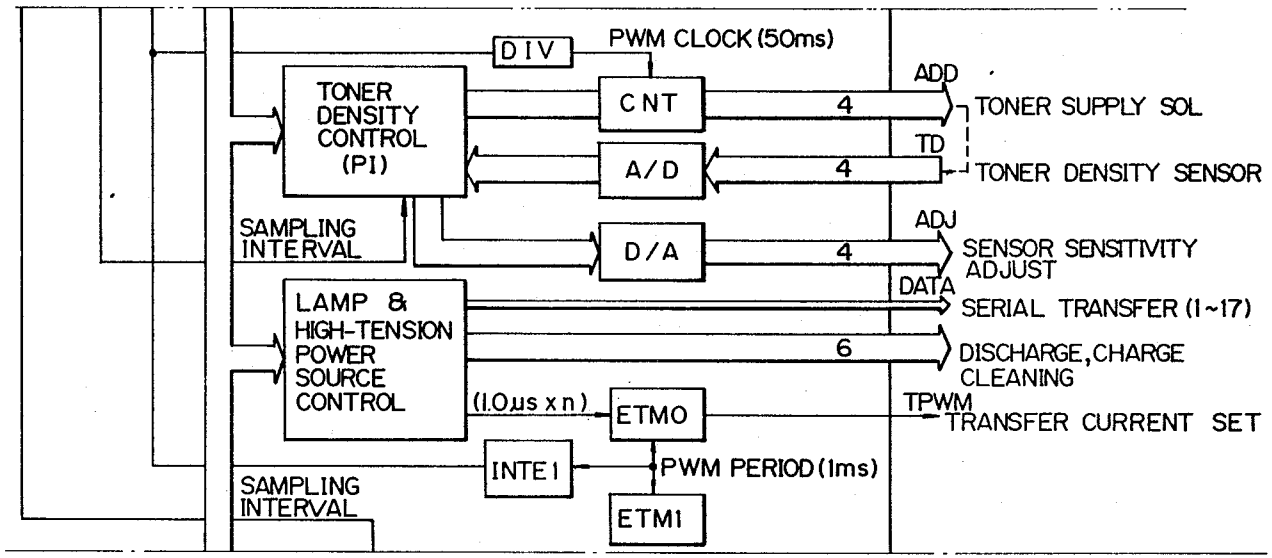
Figures 2, 12B:
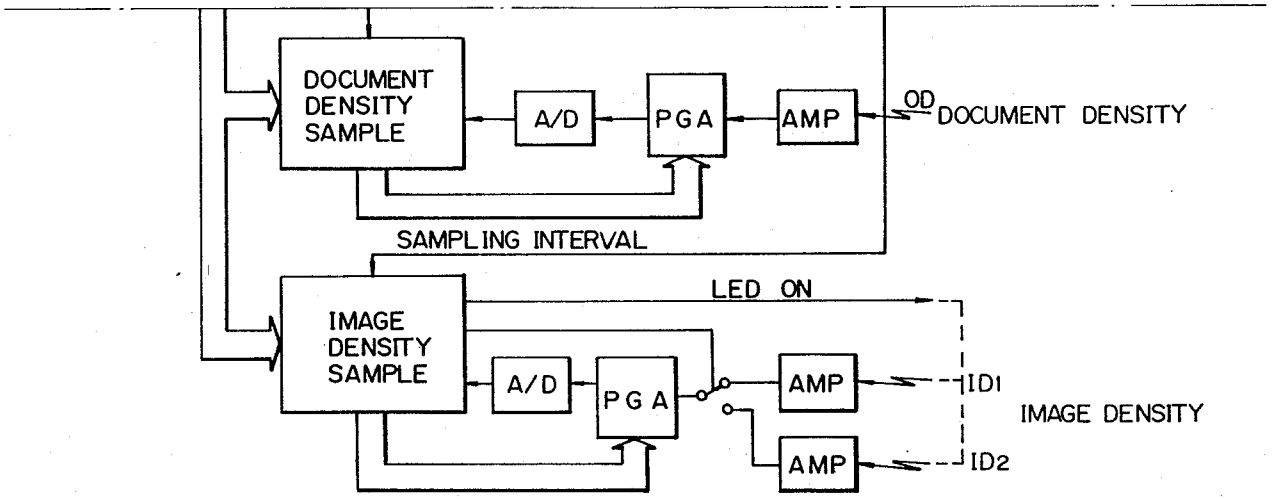

FIGS. 12A and 12B show, when combined, the hardware construction described above in a schematic functional block diagram. Generally, nine different functions are available with the apparatus, as follows.

Communication

The main controller sends data shown in FIG. 13A to the process controller 100. In response, the process controller 100 turns on and off the various loads while controlling the outputs to predetermined values. The process controller 100 in turn sends to the main controller the data which are shown in FIG. 13B and are representative of the control statuses of the process controller 100. The communication between the main controller and the process controller 100 is implemented by the full-duplex start-stop synchronizing principle; data is received and transmitted by receive interruption.

Lamp Control

A voltage applied to two illuminating lamps is stabilized and caused to follow a particular value which is set by the main controller. Specifically, the AD converter samples the terminal voltage of the lamps to produce a lamp voltage. A phase angle is calculated from the lamp voltage and a target value, and the resulting data is preset in a phase timer TM1. As timer TM1 started by a zero-cross interrupt INT1 coincides with the preset data, the lamps are turned on. Thereafter, the lamps are turned off by a zero-cross interrupt. The target lamp voltage is the product of the density $ID_1$ of the low density toner image (corresponding to the reference density plate 22) sensed by the toner image density sensty (P sensor) 8 and a constant K1. This target value is fed from the main controller.

Fixing Heater Control

The surface temperature of a fixing roller which accommodates a heater therein is stabilized and caused to follow a value which is set by the main controller. Specifically, the AD converter samples the terminal voltage of a thermistor (not shown) which is pressed against the fixing roller. From the resulting heater temperature data and a target value fed from the main controller, a phase angle is calculated and the calculated phase angle is preset in a phase angle timer TM0.

Grid Control

The potential of the grid 2 associated with a main charger corona generator is stabilized and caused to follow a target value fed from the main controller. Specifically, an AD converter samples a signal which is produced by inverting the polarity of the grid potential which is negative. A value calculated from the output of the AD converter and the target value fed from the main controller, and the calculated value is preset in a PWM pulse width timer EXTTM2. The timer EXTTM2 turns off a grid driver every time an underflow occurs, while turning it on at every period of a PWM pulse period timer EXTTM0. Hence, PWM pulses having a period of EXTTM0 and a duration of EXTTM2 are outputted.

Bias Control

Bias voltages applied to the BL, Y, M and C developing units are stabilized and caused to follow a target value fed from the main controller. Specifically, the AD converter samples a signal produced by inverting each bias voltage which has negative polarity. An output value is calculated from the sampled voltage and the target voltage and then preset in a PWM pulse width timer EXTTM1. The timer EXTTM1 turns off a bias driver every time an underflow occurs and turns it on at every period of a PWM pulse period timer EXTTM0. Consequently, PWM pulses having a period of EXTTM0 and a duration of EXTTM1 are produced. It is to be noted that the timers EXTTM0, EXTTM1 and EXTTM2 used in the grid control and bias control are built in the IC 410 shown in FIG. 11C.

Toner Density Control

The toner conentrations of the developers individually stored in the BL, Y, M and C developing units are stabilized and caused to follow a target value fed from the main controller. Specifically, the AD converter samples the output signal of each toner density sensor SET, FIG. 8. An output value is calculated from the output of the AD converter and the target value and then preset in a PWM pulse width counter CNT. The counter CNT turns off a toner supply solenoid every time an underflow occurs and turns it on at every PWM period to thereby preset the calculated value. More specifically, the duration of toner supply is controlled by PWM pulses the duration of which is determined by the counter CNT. Sensitivity adjustment data is fed to each toner density sensor via the AD converter. The target toner density is the product of the density $ID_2$ of the high density toner image (solid image formed without illumination being effected) sensed by the toner image density sensor (P sensor) 8 and a constant Kt.

Discharge Lamp and Voltage Source Control

Power sources associated with the main charger, pretransfer discharge lamp (PTL), precleaning discharge, drum cleaner bias and transfer cleaner bias are on-off controlled, while a target value for a power source associated with the transfer charger is outputted. The other outputs are transferred serially and, at the destinations, transformed into parallel data for on-off controlling the associated loads. The current for the transfer charger is set by the PWM system which varies the duty of pulses having a constant period. Specifically, as shown in FIG. 12B, the timer defines a period, while the timer ETM0 generates a duration. Hence, the data written in TEM0 is the target transfer charger current. All the timers TM0, TM1, ETM0 and ETM1 are built in the microcomputer IC412.

Document Density Sampling

The AD converter samples the output signal of the document density sensor 18 via a programmable gain amplifier so as to sense the density of the reference density plate 22 and that of the document surface. The sampling is effected in response an interrupt INT1 which is synchronous to the zero-cross signal.

Toner Image Density Sampling

The output signal of the toner image density sensor (P sensor) 8 is sampled so as to sense the density $ID_1$ of the low density toner image and the density $ID_2$ of the high density toner image which are formed on the drum 19. The sampling timing is defined by a serial signal received from the main controller.

Figure 14:
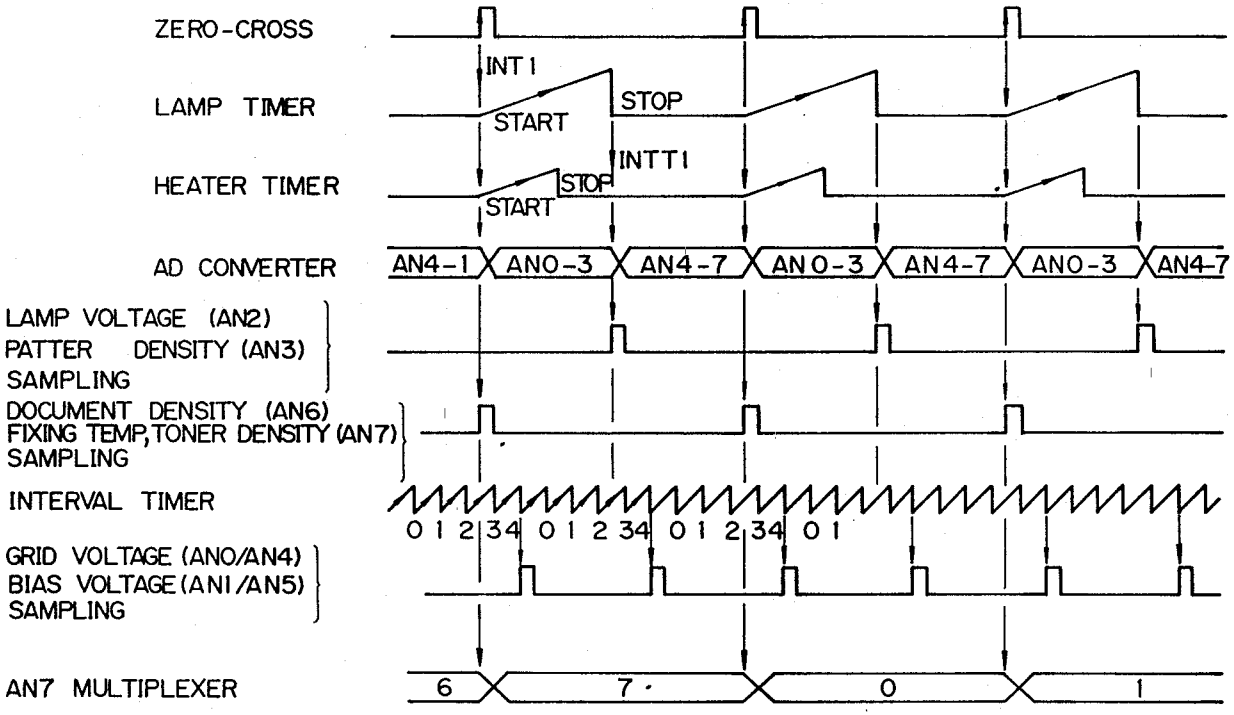
FIG. 14 is a timing chart useful for understanding the operation the process control unit.

The sampling timings mentioned above in relation to the functions shown in FIGS. 12A and 12B will be described more specifically. FIG. 14 is a timing chart demonstrating the channel switching and sampling of the AD converter. The AD converter built in the microcomputer IC412 has eight channels, while only four registers are available for storing the results of AD conversion. Hence, the ports AN0 to AN3 and AN4 to AN7 are switched over on a time division basis. In the illustrative embodiment, the switchover is effected every time one of the zero-cross interrupt INT1 and lamp timer interrupt INTT1 occurs. It follows that while AN0 to AN3 are selected, the signals on AN4 to AN7 cannot be sampled and, while AN4 to AN7 are selected, signals on AN0 to AN3 cannot be sampled. However, the grid voltage and bias voltage have to be sampled even when AN0 to AN3 or AN4 or AN7 are selected. In this embodiment, therefore, the grid voltage is applied to the channels AN0 and AN4, while the bias voltage is applied to the channels AN1 and AN5.

Figure 15:
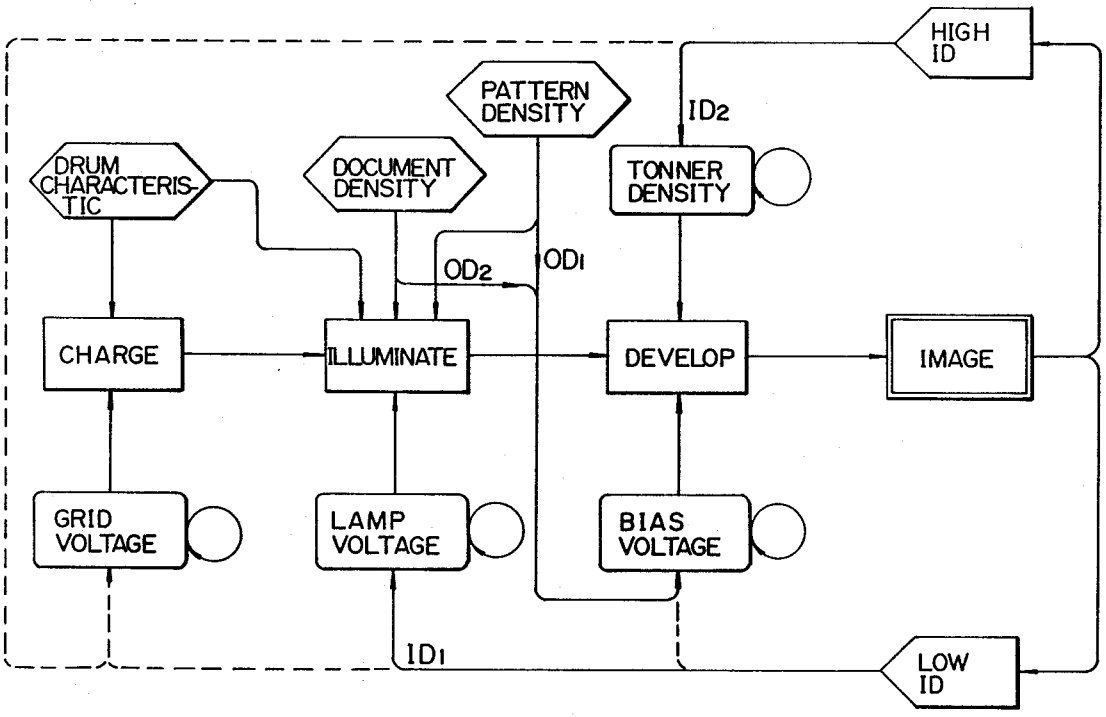
FIGS. 15 and 16 are block diagrams schematically showing an essential part of the process control over the copier shown in FIG. 1.
Figure 16:
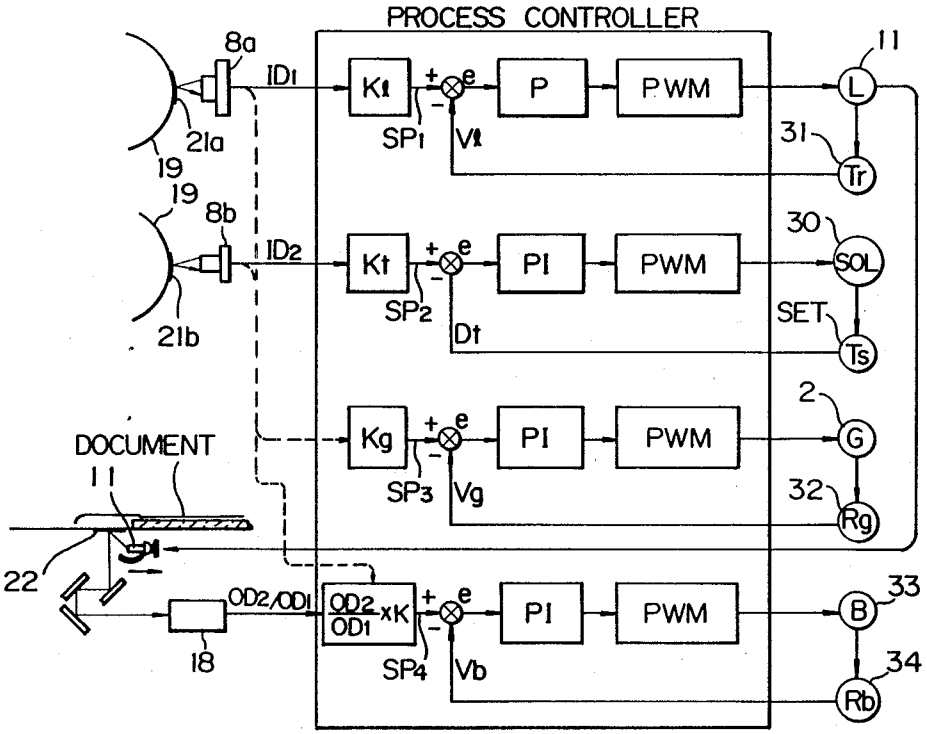

Referring to FIGS. 15 and 16, major contents of process control of the illustrative embodiment will be described. As shown in FIG. 15, the copying process for forming a toner image on the drum 19 includes charging, exposing and developing process elements. A change in the characteristics of a photoconductive element (drum) effects the charging and exposing processes, i.e., the surface potential on the drum after the charging process and the surface potential after the exposing process are each varied based on the characteristics of the drum. The density of a document has influence on the exposing process, i.e., the surface potential of the drum becomes relatively high when the document density is high and becomes relatively low when the document density is low. Further, the toner density of the developer stored in each of the developing units has influence on the density of a toner image to be produced by development. In the illustrative embodiment, the variations occurring in the individual processes as stated are compensated for to maintain the recording quality constant, as follows. First, the pattern densities $OD_1$ and $OD_2$ of the reference density plate 22 and document surface, respectively, are sensed so as to adjust the bias voltage (target value) in the developing process on the basis of their ratio $OD_2/OD_1$. Also, the density (low ID; $ID_1$) of the image associated with the density of the reference density plate 22 is sensed in order to adjust the voltage (target value) of the illuminating lamp on the basis of the sensed density. Further, the density of the solid image formed without exposure is sensed to adjust the toner density (target value) of each developing unit on the basis of the sensed density. Alternatively, the bias voltage for development or the grid voltage of the main charger may be adjusted in response to the sensed density $ID_1$ of the toner image, or he grid voltage may be adjusted in response to the sensed density $ID_2$ of the toner image, as schematically represented by phantom lines in FIG. 15.

As shown in FIG. 16, the amount of light issuing from the lamp 11 (applied voltage), the energizing times of the toner supply solenoids 30 associated with the individual developing units, the voltage applied to the grid 2 of the main charger and the bias voltages applied to the electrodes 33 of the individual developing units are controlled on a feedback basis by independent systems. Specifically, the terminal voltage of the lamp 11 is sensed by a sensing circuit 31 while a voltage V1 associated with the sensed voltage is fed back. A signal MV produced by proportional processing of a difference or error e between the voltage V1 and a target voltage $SP_1$ is fed to the input of PWM processing. A voltage to be applied to the lamp 1 is determined by an output of the PW processing. Hence, the amount of exposure is controlled by a closed loop to coincide with the target value $SP_1$. Concerning the control of the toner supply solenoid 30, the toner density is sensed by the sensor (F sensor) SET while a signal Dt representative of the sensed toner density is fed back. A difference or error e between the signal Dt and a target value $SP_2$ is subjected to proportional integration, and the resulting signal is applied to the input of PWM processing. The amount (duration) of energization of the solenoid 30 is, therefore, determined by an output of the PWM processing. Likewise, the voltage applied to the grid 2 is sensed by a sensing circuit 32, and a signal Vg representative of the sensed voltage is fed back. A signal produced by the proportional integration of a difference or error e between the signal Vg and a target value $SP_3$ is applied to the input of PWM processing, whereby a voltage to be applied to the grid 2 is determined by an output of the PWM processing. The bis voltage applied to the electrode 33 is sensed by a sensing circuit 34, and a signal Vb representative of the sensed voltage is fed back. A signal produced by proportional integration of an error e between the signal Vb and a target value $SP_4$ is fed to the input of PWM processing, so that a bias voltage is determined by an output of the PWM processing. The target amount of illumination $SP_1$ is determined as a product of the density $ID_1$ of the low density toner image sensed by the sensor 8*a* and the constant K1, while the target amount of solenoid energization $SP_2$ is determined as a product of the density $ID_2$ of the high density toner image sensed by the sensor 8*b* and the constant Kt. Further, the target bias voltage $SP_4$ is determined as a product of the ratio of $OD_2$ (document density) sensed by the document density sensor 18 and $OD_1$ (density of reference density plate 22) and the constant Kb.

Specific operations of the process controller 100 will be described with reference to FIG. 17 and successive drawings.

Figures 1, 17:
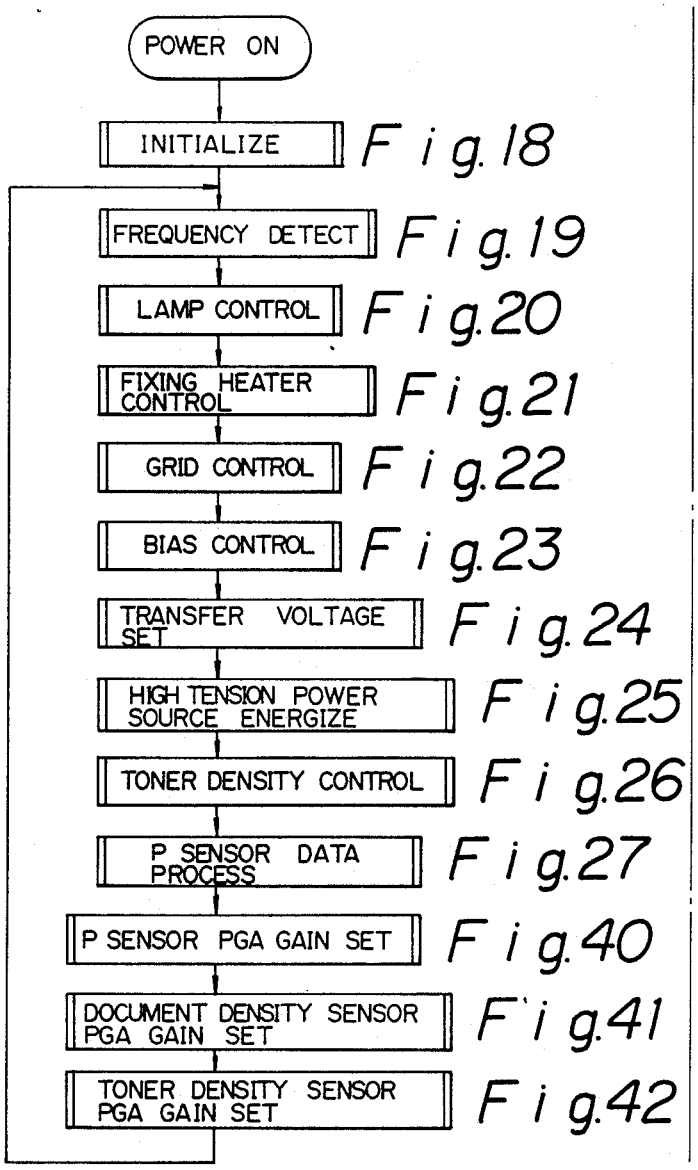
FIGS. 17 to 31 are flowchart demonstrating specific operations of the process controller.

FIG. 17 shows the outline of the control and the kinds of interrupt processing. The subroutines shown in FIG. 17 will be described in detail.

Figure 18:
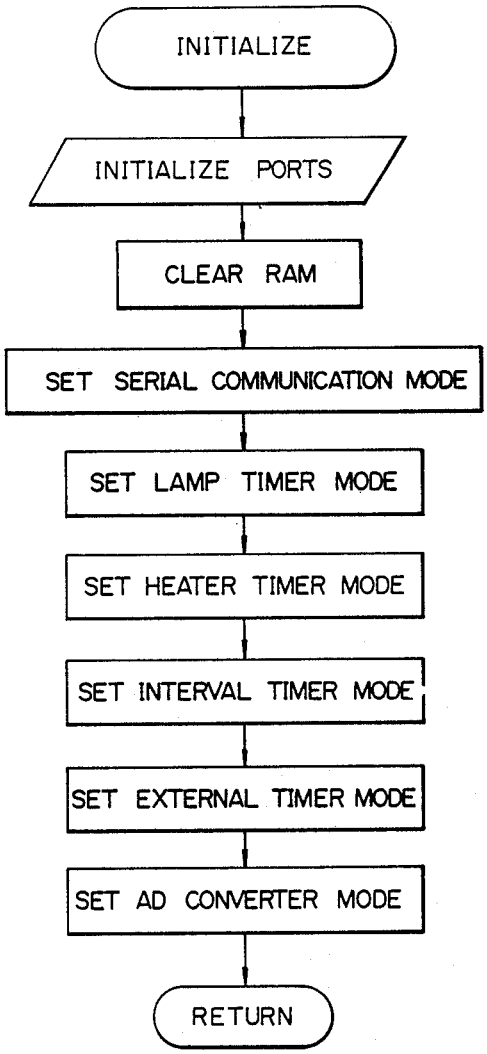

Initialize (FIG. 18)

The RAM, ports, serial communication, timers, AD converter and other components are initialized.

Figure 19:
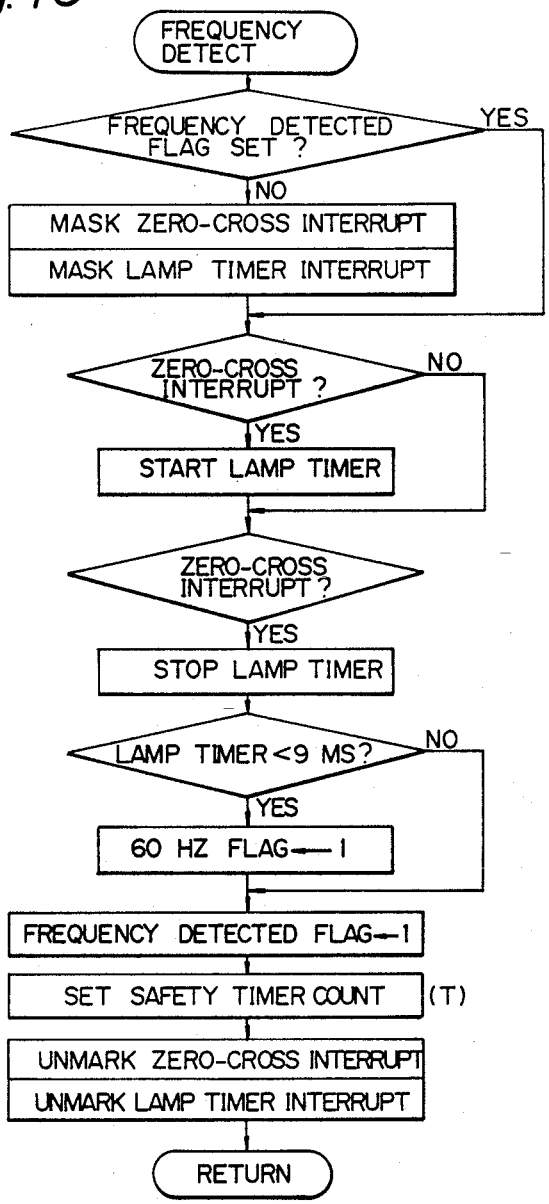

Frequency Detect (FIG. 19)

By using the lamp phase angle timer TM1, the period of zero-cross interrupt is measured only once. The frequency is 60 hertz if TM1 (9 milliseconds and 50 hertz if TM1) 9 milliseconds. Although masking the lamp timer interrupt INTT1 and zero-cross interrupt IN1 will disable an interrupt, whether or not zero-crossing has been detected can be tested because an interrupt request flag is set. After the frequency has been determined, preset values A and T are respectively loaded in an SE strobe counter an a safety timer the operating times of which depend on the frequency.

Figure 20:
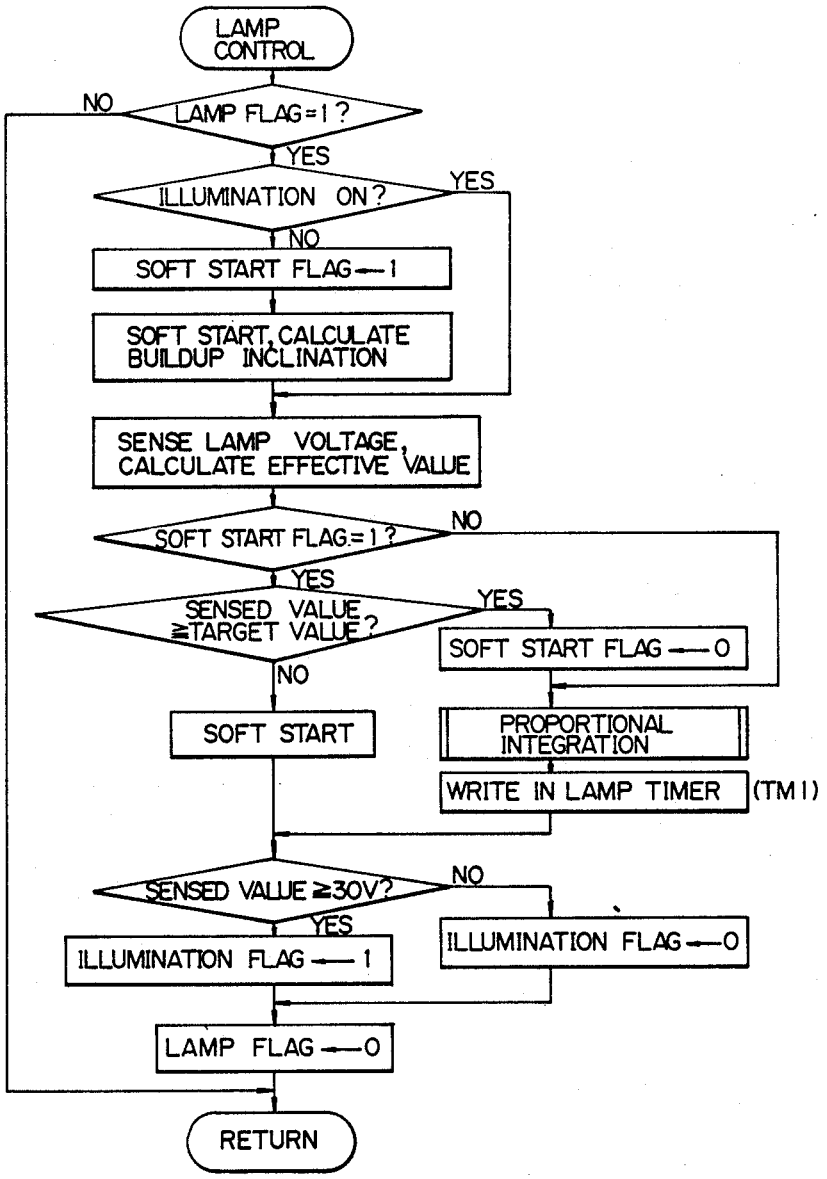

Lamp Control (FIG. 20)

An effective value is calculated from the lamp voltage which has been sensed by a lamp timer interrupt (described later). The calculated effective value and a target value ($SP_1$, FIG. 16) are subjected to proportional integration to determine a value to be loaded in the lamp timer, i.e., a lamp phase angle, resulting in the lamp timer being updated by the lamp phase angle. To call the proportional integration subroutine, a flag for discriminating proportioning and proportional integration and a flag discriminating an adding timer and a subtracting timer. The lamp control is implemented by proportioning and an adding timer. At the start of illumination, the phase angle is increased little by little, i.e., a so-called soft start is performed. The lamp voltage is constantly sampled and, when it is higher than 30 volts, a bit representative of "exposing" is set. This routine is executed only when a flag indicative of the end of lamp voltage sampling, i.e., a lamp flag is set, and it will be skipped if the lamp flag has been reset.

Figure 21:
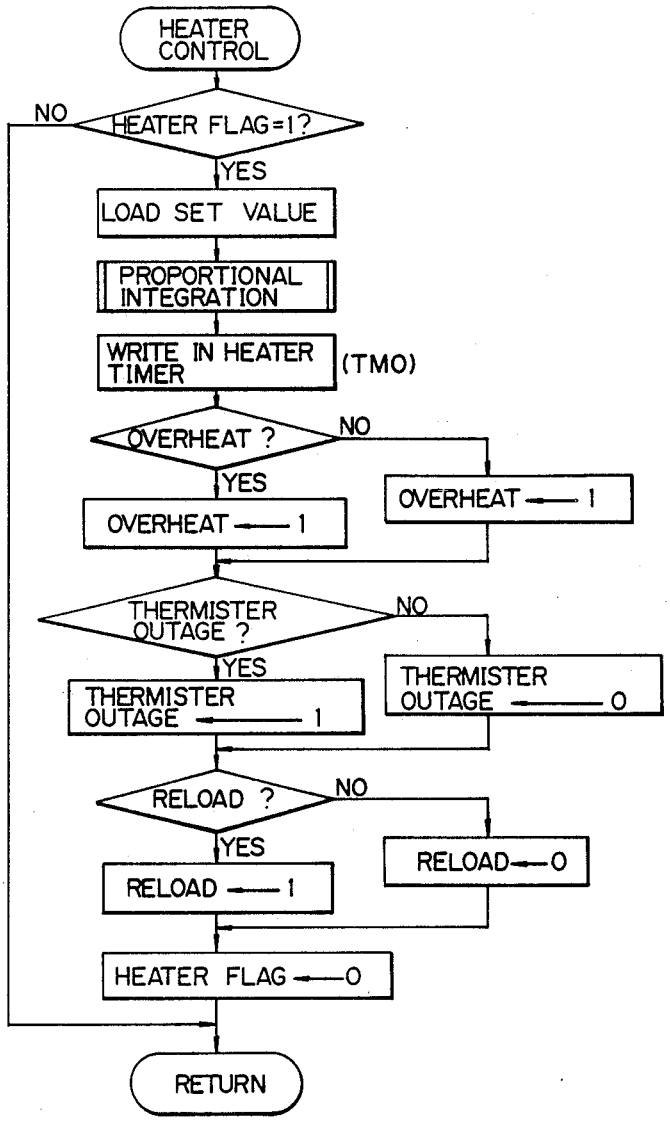

Heater Control (FIG. 21)

This routine, like the lamp control routine, is executed only when a heater flag indicative of the end of fixing temperature sampling is set. First, a heater phase angle to be loaded in a heater timer is calculated from the fixing temperature sampled by a zero-cross interrupt (described later) and the target value fed from the main controller, thereby updating the heater timer. The sampled fixing temperature is determined as to overheat, thermistor outage, reload temperature (operable temperature) and other similar factors, and individual status bits are manipulated accordingly.

Figure 22:
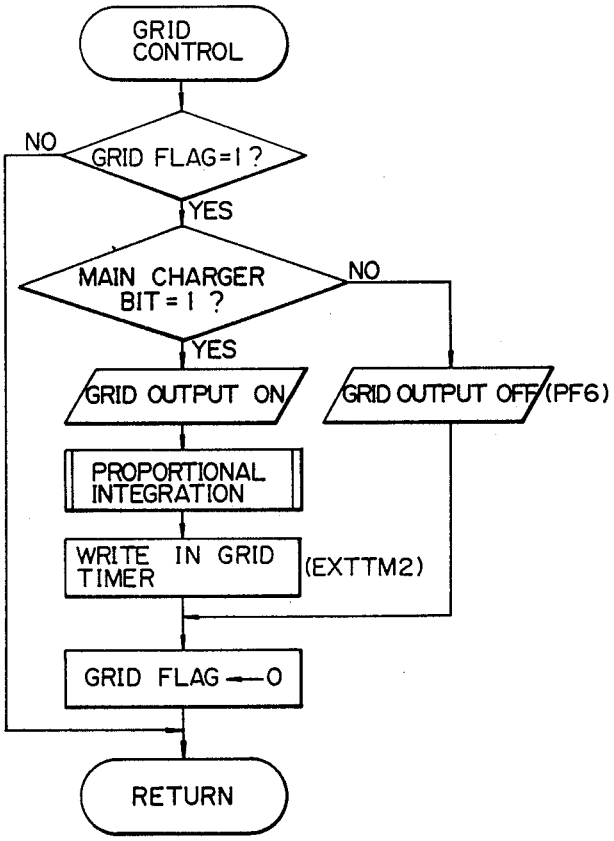

Grid Control (FIG. 22)

This routine is also executed only when a grid flag indicative of the end of grid voltage sampling is set. The grid voltage is turned on and off at the same timing as the main charger. Specifically, a grid output (PF6) is turned on if a "main charger" bit is a (logical) ONE and turned of if it is a (logical) ZERO.

Figure 23:
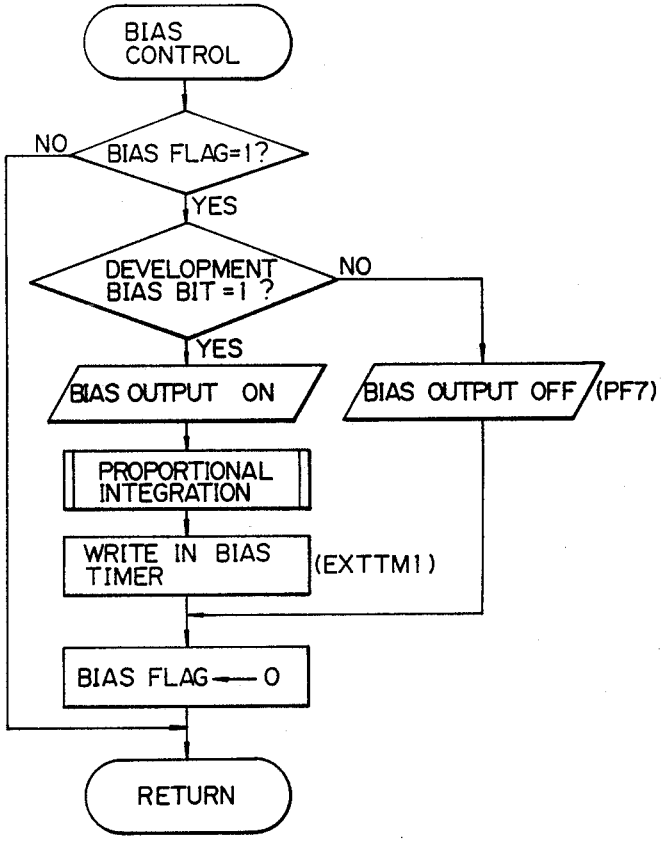

Bias Control (FIG. 23)

This routine is executed only when a bias flag indicative of the end of bias voltage sampling is set. A bias output (PF5) is turned on to effect proportional integration if a "bias" bit is a ONE and turned off it is a ZERO.

Figure 24:
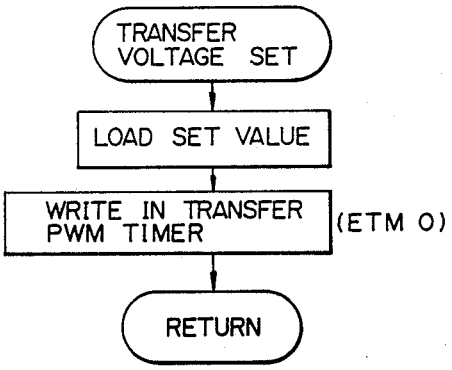

Transfer Current Set (FIG. 24)

A "set transfer charge current" received from the main controller and stored in the receive buffer is written in the transfer PWM timer ETM0.

Figure 25:
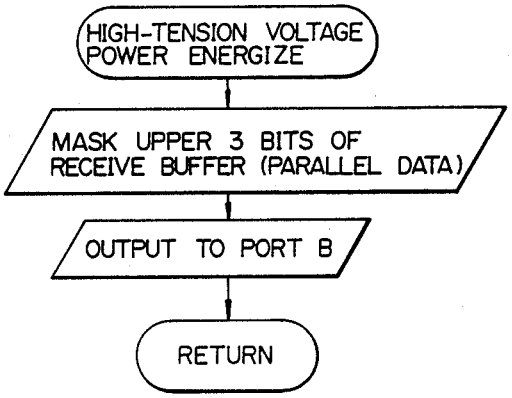

High-Tension Power Source Energize (FIG. 25)

Lower five bits of "parallel data" fed from the main controller and stored in the receive buffer are delivered to ports PB0 to PB4.

Figure 26:
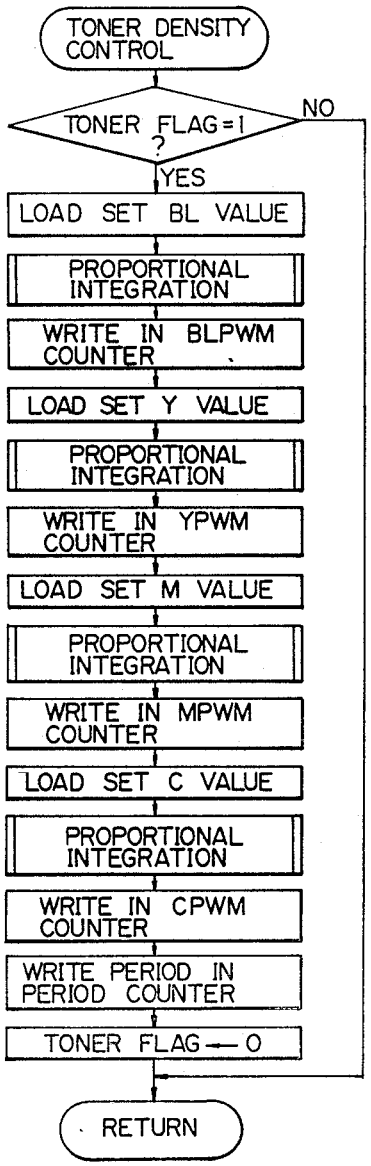

Toner Density Control (FIG. 26)

This routine is executed only when a toner flag showing that the timing for energizing the toner supply solenoid has been reached is set. Counters BLPWM, YPWM, MPWM and CPWM for turning on and off the toner supply solenoids associated with the BL, Y, M and C developing units, respectively, are each loaded with a result of proportional integration of a difference or error between the target toner density ($SP_2$, FIG. 16) and the output of the toner density sensor.

Figure 27:
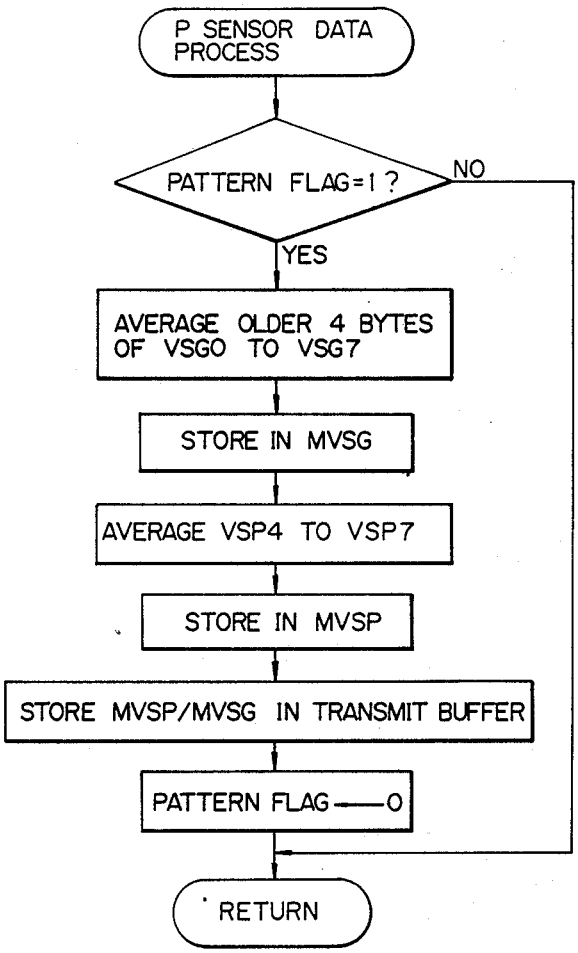

P Sensor Data Process (FIG. 27)

This routine is executed only when a pattern flag showing that the density $ID_1$ of the low density toner image and the density $ID_2$ of the high density toner image sensed by the P sensor (toner image density sensor 8) have been sampled is set. A sampling buffer stores densities VSG0 to VSG7 sensed at eight points of the low density toner image and densities VSP0 to VSP7 sensed at eight points of the high density toner image, as shown in FIG. 23. Four of the densities VSG0 to VSG7 and four of the densities VSP0 to VSP7 which have the boundary of the low density and high density toner images therebetween are discarded. A ratio of mean value MVSG of the remaining four densities of the low density toner image and a mean value MVSP of the remaining four densities of the high density toner image is calculated and then stored in the transmit buffer to be sent to the main controller.

Figure 29:
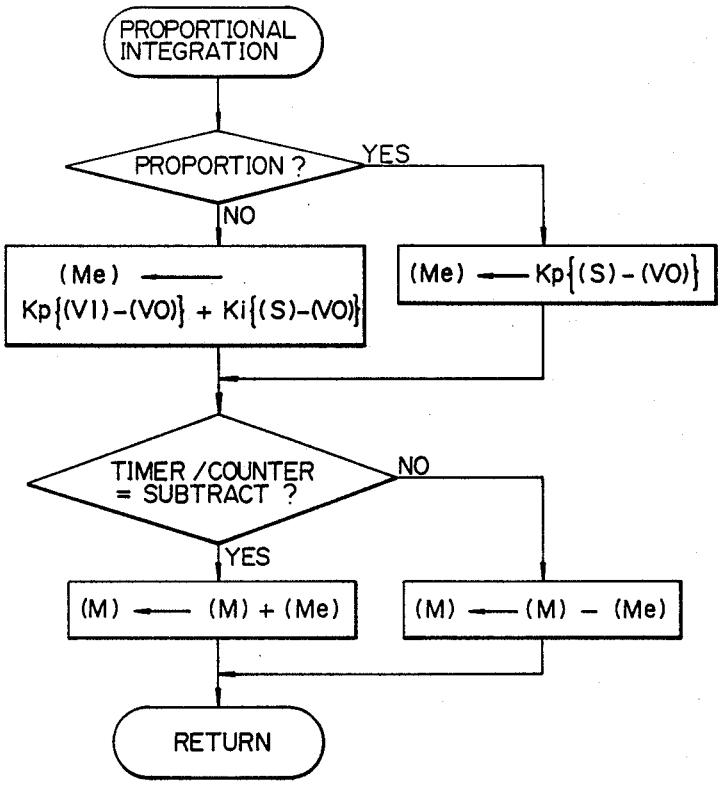

Referring to FIG. 29, a "Proportional Integration" subroutine to be called by the previous routine will be described. In FIG. 29, V0, V2, S, Kp, Ki, Me and M are representative of current sampled data, immediately preceding sampled data, target value, proportion gain, integration gain, variation in the amount of manipulation, and amount of manipulation, respectively. When this subroutine is called after setting specific values on V0, V1, S, Kp and Ki, the program will return to the previous routine with a value to be written in the timer or the counter being stored in M.

Interrupt routines are as follows.

Figure 30:
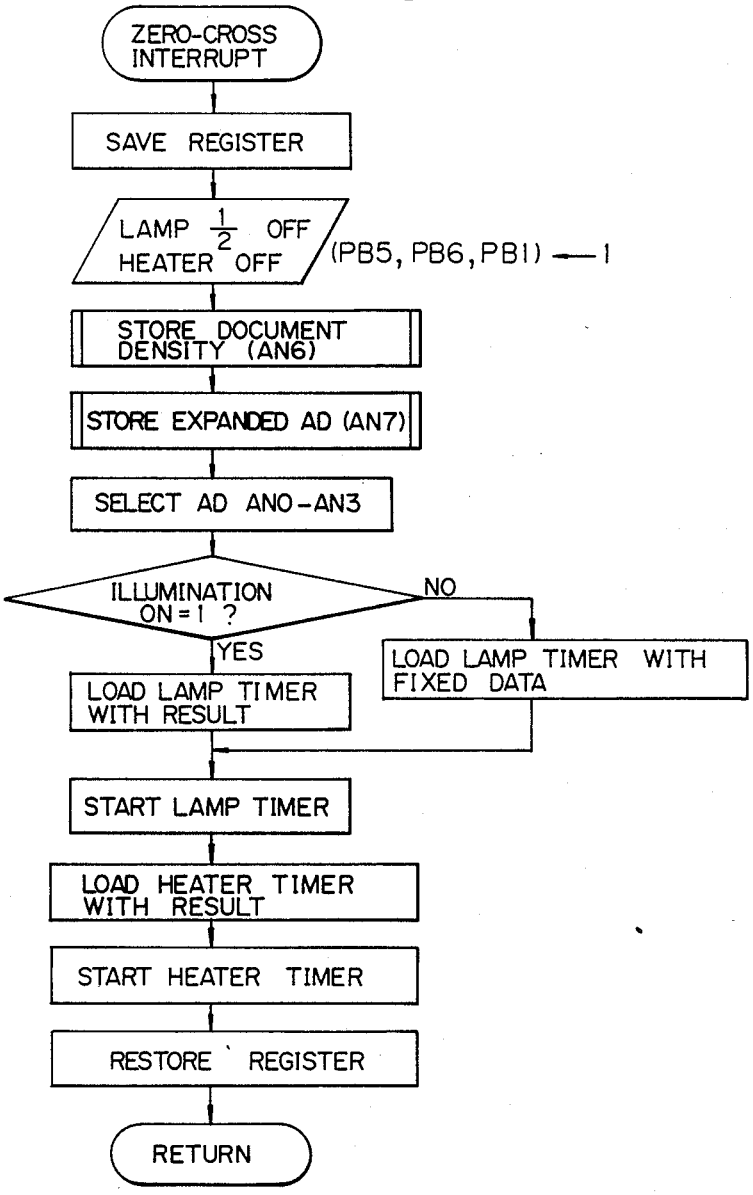

Zero-Cross interrupt (FIG. 30)

Figure 31:
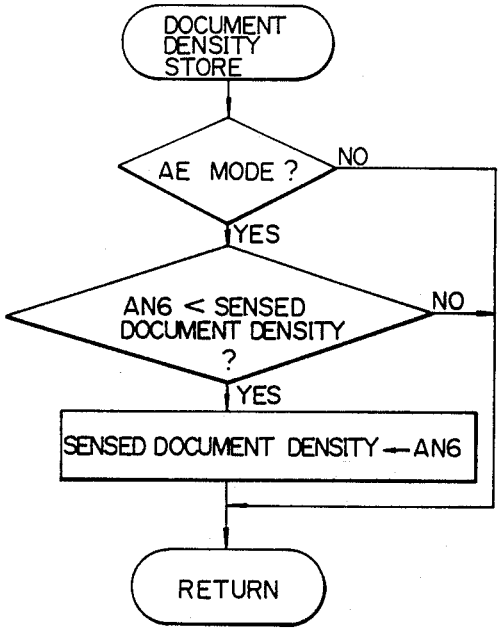
Figures 2, 32C:
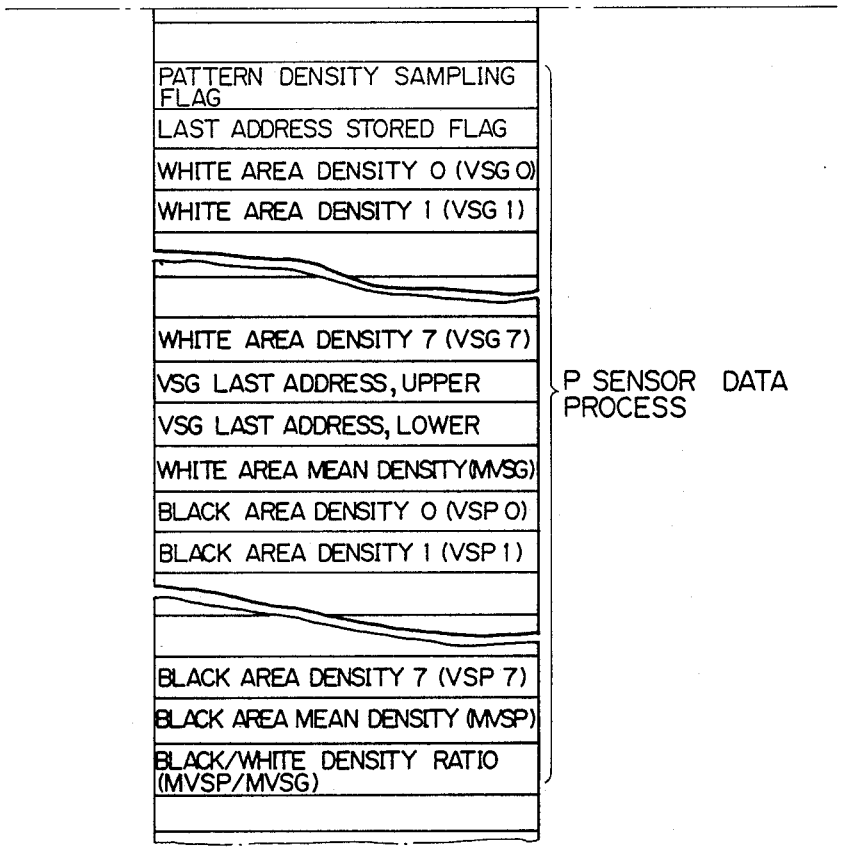
Figure 32D:
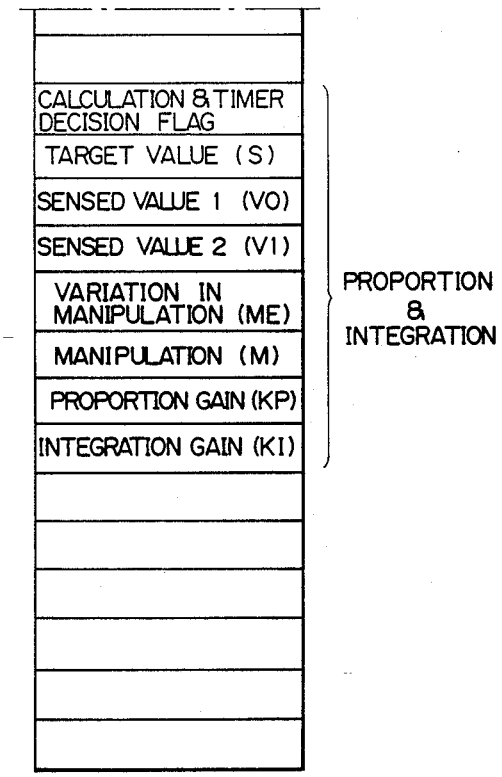
Figure 33:
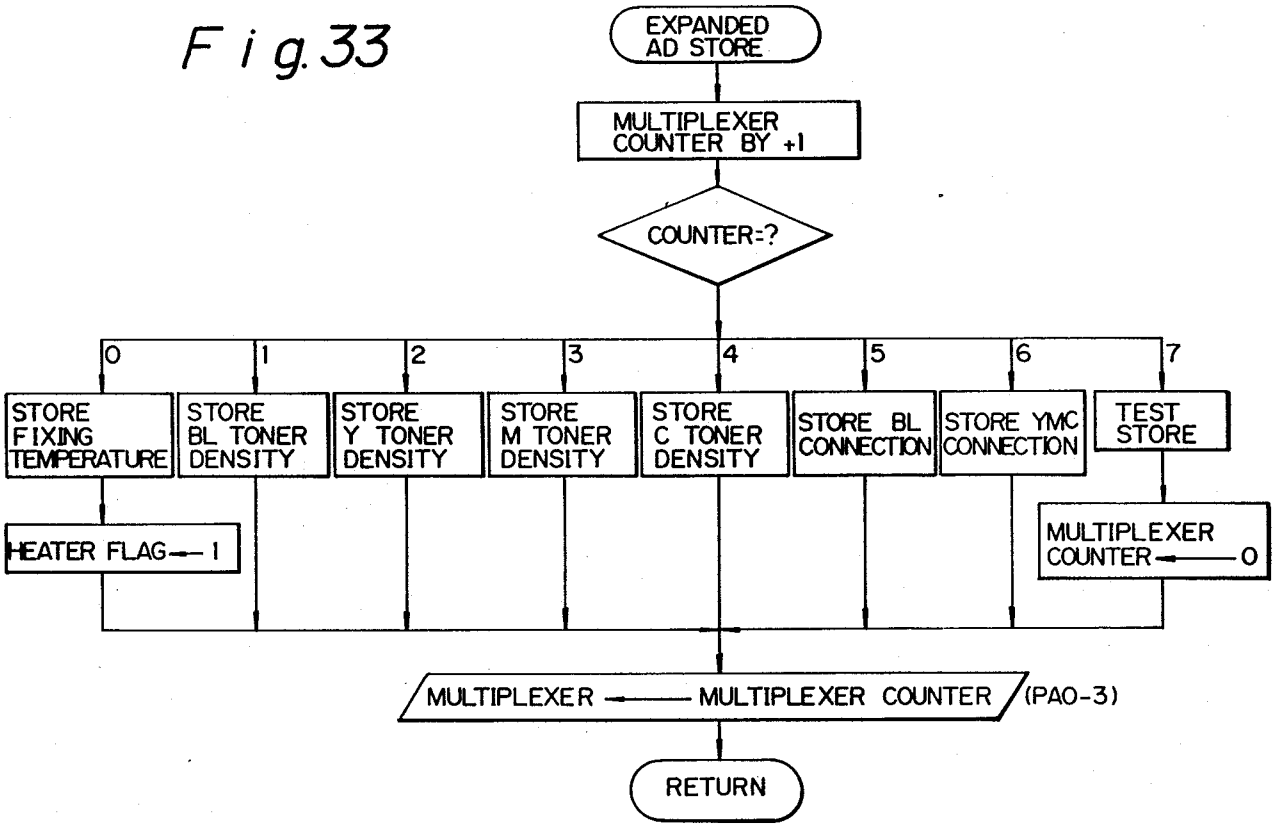
FIGS. 33 to 35 are flowchart showing specific operations of the process controller.

This routine is started at the positive-going edge of a zero-cross interrupt input INT1. In a subroutine "Document Density (AN6) Store", the document density sensor 18 samples the densities on the document surface and thereby reads the background density which is the lowest density. As shown in FIG. 31, when bit 7 of the serial data 1, FIG. 13A, labeled "AE Mode" is a ONE, i.e:, when a document density sampling mode is set up, lower one of the results of AD conversion associated with the document density (AN6) is read and stored in a sampling buffer shown in FIGS. 32A to 32D. In an "Expanded AD (AN7) Store" surbroutine, as shown in FIG. 33, every time this routine is called by an octonary multiplexer counter, the data sampled at AN7 are stored in the sampling buffer shown in FIGS. 32A to 32D, i.e., "Sensed BL Toner Density 1 and 2", "Sensed M Toner Density 1 and 2", "Sensed C Toner Density 1 and 2", "BL Developing Unit Connect", and "YMC Developing unit Connect". Since the lamp voltage is constantly monitored with no regard to a lamp ON bit "Illumination ON", the lamp timer is started even when "Illumination ON" is a ZERO (the lamp voltage is sampled by a lamp timer interrupt).

Figure 34:
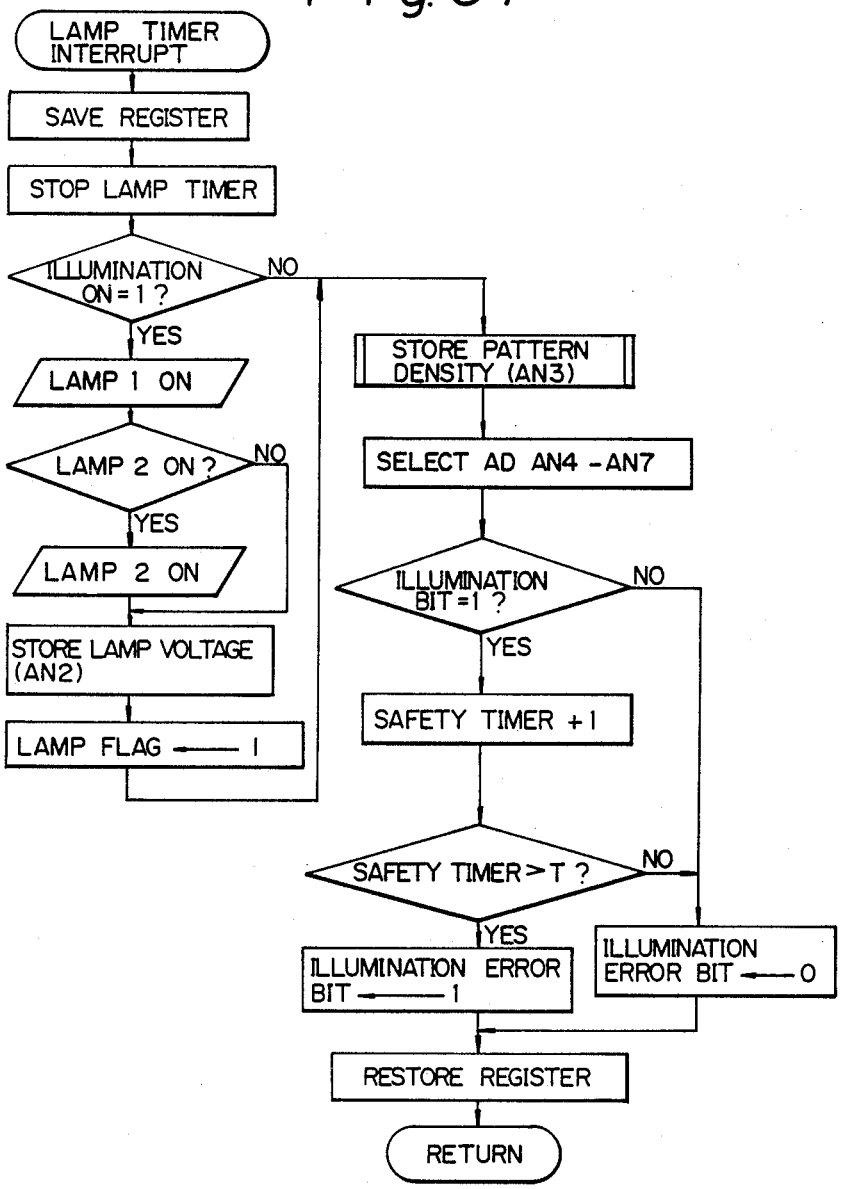

Lamp Timer Interrupt (FIG. 34)

"Illumination ON" and "Lamp 2" are the commands which are shown in FIG. 13A and stored in the receive buffer. "Exposing" is representative of a flag which has been set or reset by the lamp control routine and is representative of a status shown in FIG. 13 and stored in the transmit buffer. When the "exposing" flag is set and continuously set for more than a predetermined period of time T as counted by the safety timer, an "exposure error" bit, FIG. 13B is set to report it to the main controller.

Figure 28:
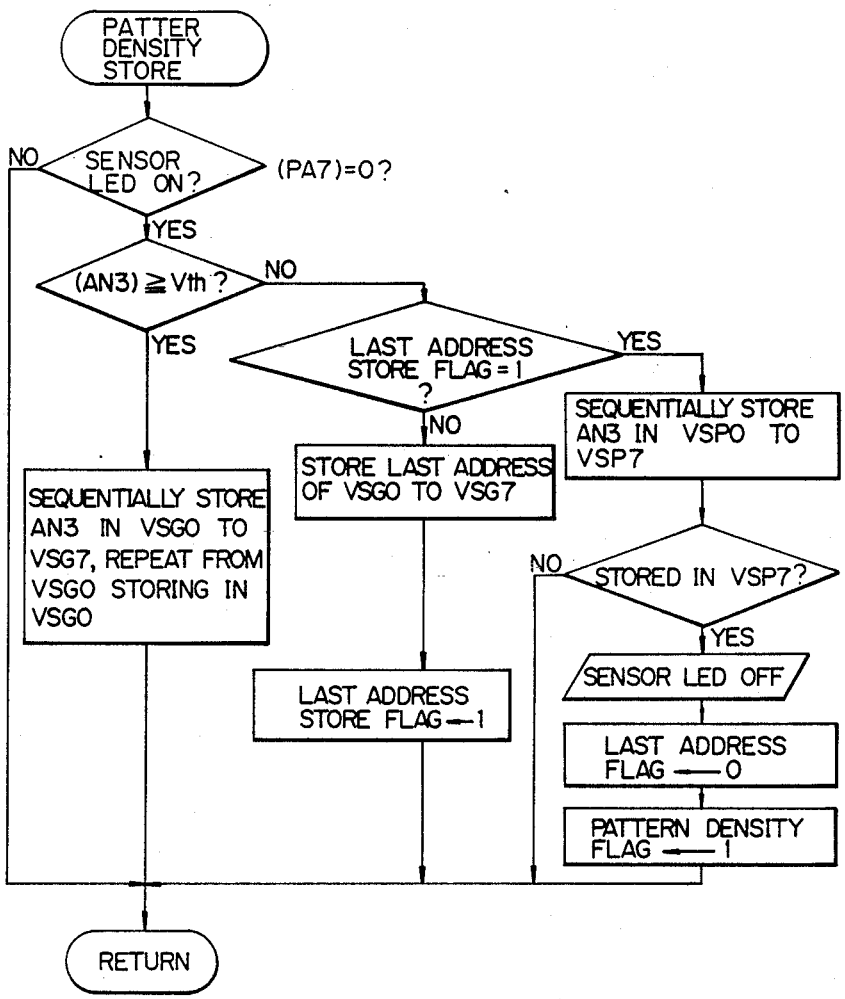

Pattern Density Store (FIG. 28)

This routine is adapted to store in the transmit buffer the sampled data of toner image pattern as sensed by the P sensor. The sampling begins when the LED of the P sensor turned on by a serial receive interrupt (FIG. 35) is ON. When the pattern density input AN3 is higher than a threshold density Vth, the data associated with the eight points are sequentially stored in the sampling buffers VSG0 to VSG7 by determining that the input AN3 is associated with the low density toner image. Here, it is not that the data are stored in VSG0 to VSG7 only once but that they are repetitively stored until AN3 becomes lower than Vth. As AN3 becomes lower than Vth, the last address of VSG0 to VSG7 is stored so that data appearing thereafter may be sequentially stored in VSP0 to VSP7. After data has been stored in VSP7, the LED of the P sensor is turned off while a pattern density flag indicative of the end of toner image density sampling is set. How the toner image density is sampled is shown in FIG. 36.

Figure 37:
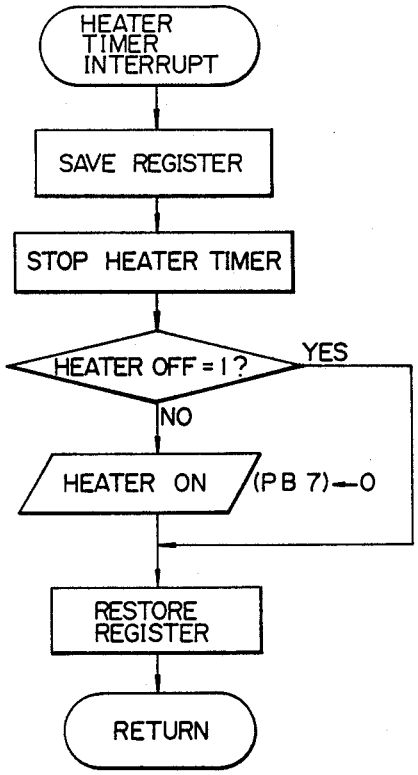
FIGS. 37 to 42 are flocharts demonstrating specific operations of the process controller.

Heater Timer Interrupt (FIG. 37)

If a "Heater OFF" bit of the serial receive buffer is a ZERO, the heater is turned on.

Figure 38:
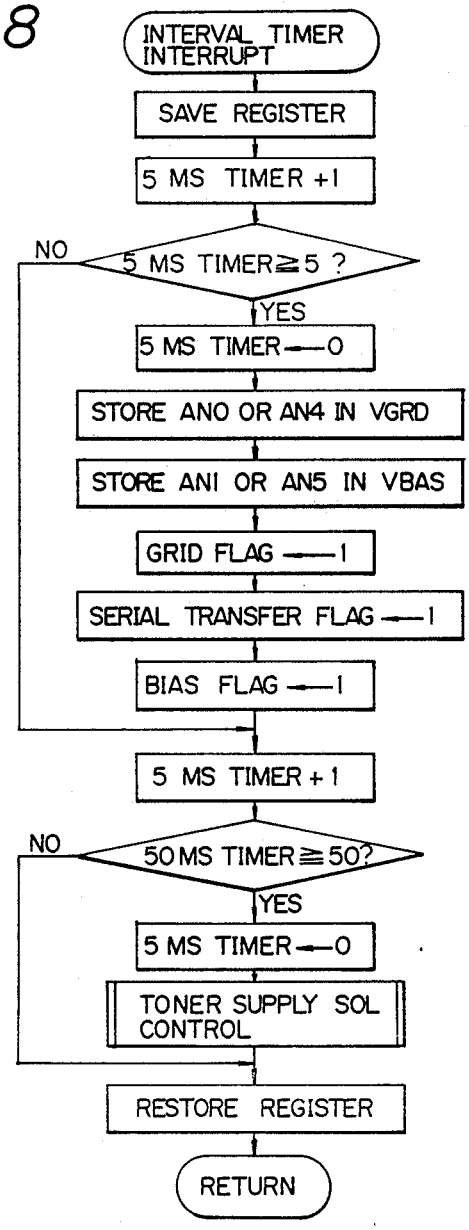

Interval Timer Interrupt (FIG. 38)

Figures 1, 39:
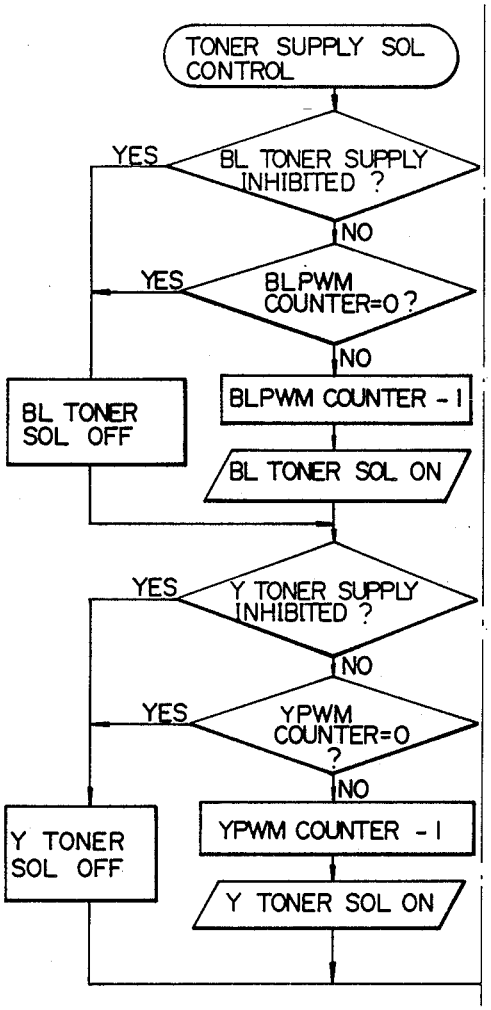
Figures 2, 39:
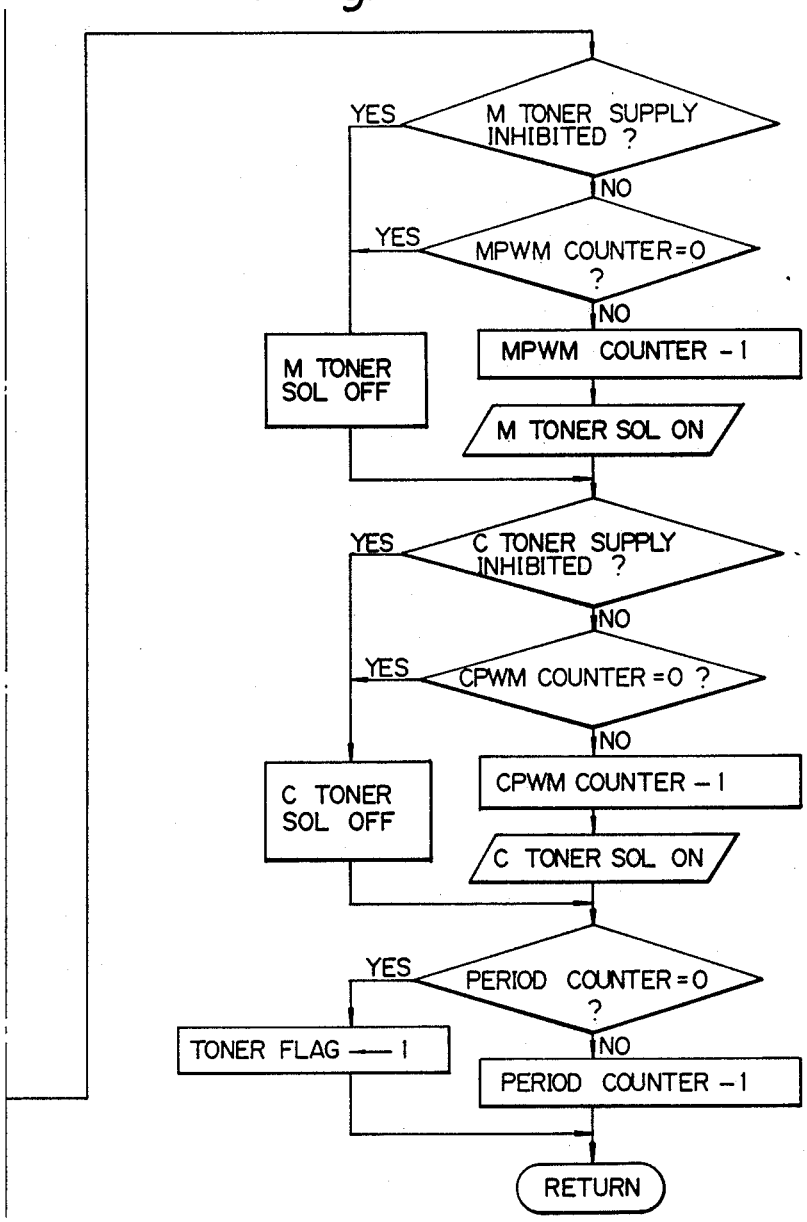

An interval timer is a 1 millisecond timer and bifunctions as the PWM period timer adapted to set a transfer current as previously stated. A 5 millisecond timer and a 50 millisecond time are produced out of the 1 millisecond timer. The grid voltage and bias voltage are sampled and the serial transfer flag is set, every 5 milliseconds each. The toner supply solenoids are controlled every 50 milliseconds, as shown in FIG. 39.

Figures 1, 35:
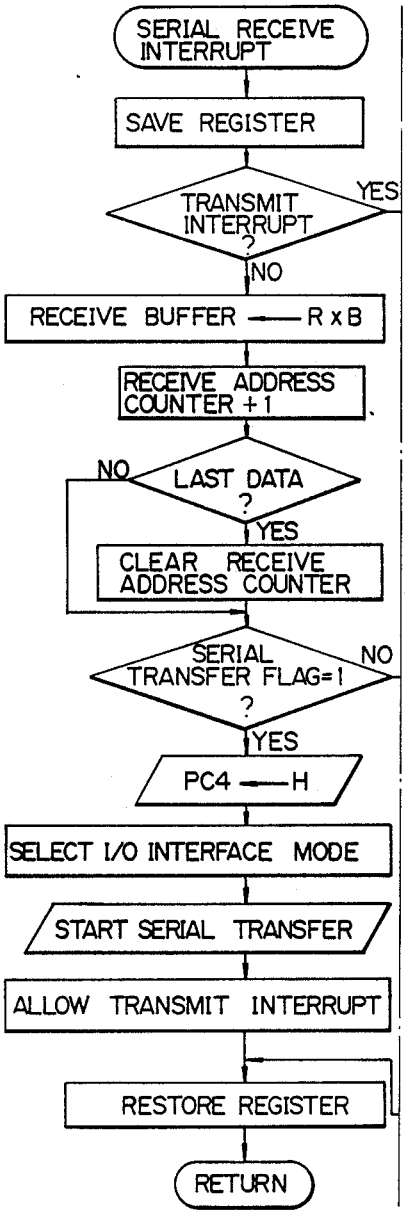
Figures 2, 35:
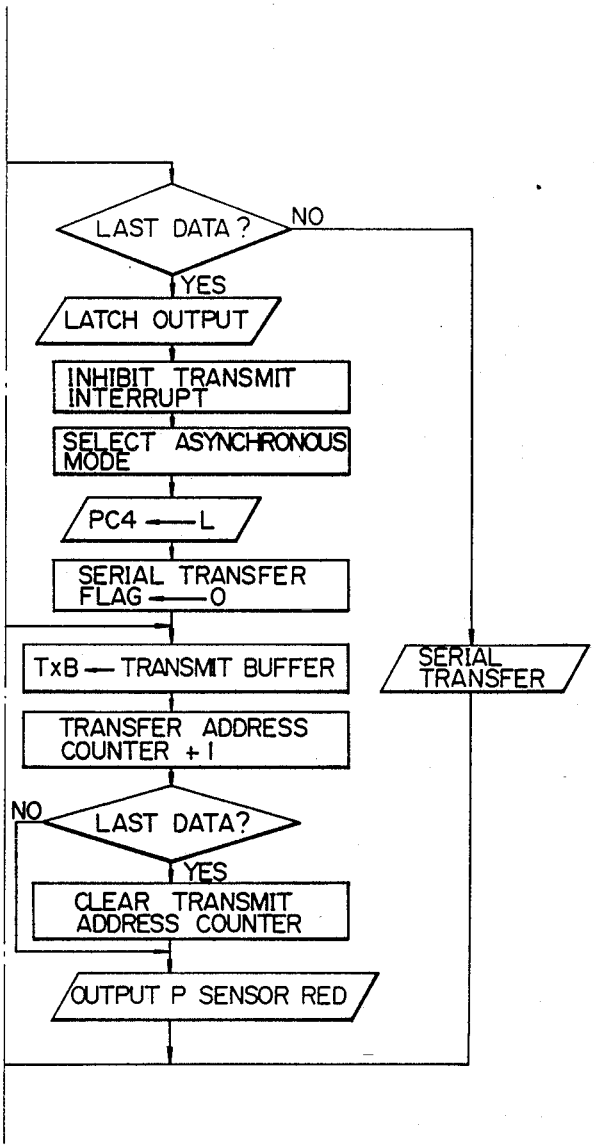
Figure 36:
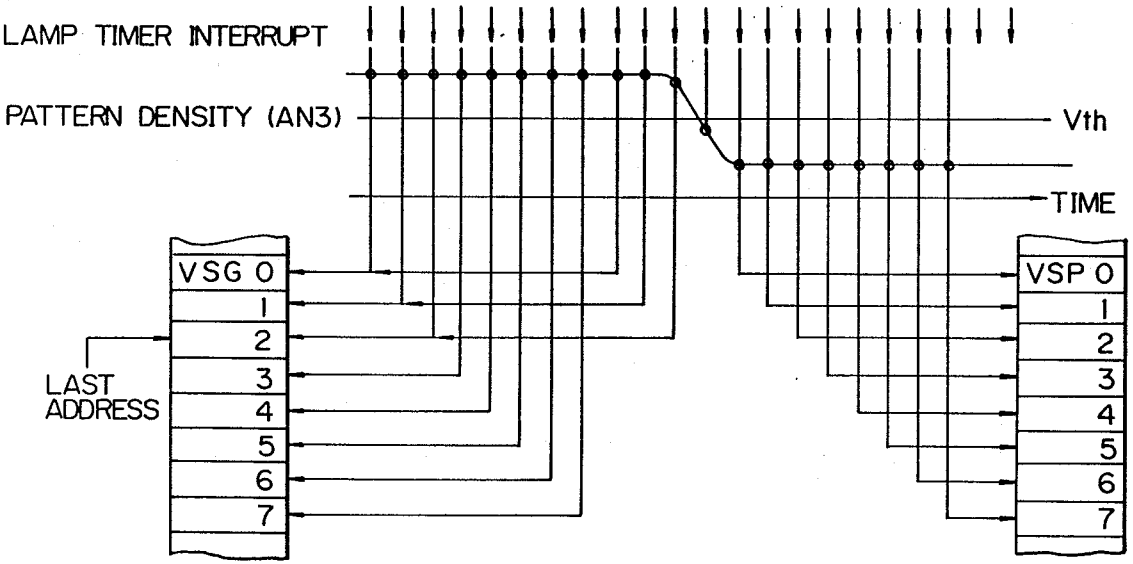
FIG. 36 is a timing chart representative of signal sampling timings.

Serial Receive Interrupt (FIG. 35)

The serial received data formatted as shown in FIG. 13A are stored in the receive buffer of FIG. 32A, while data formatted as shown in FIG. 13B are transmitted from the transmit buffer of FIG. 32B. Since both the transmit and receive interrupts access the same address, what is done at first is to determine whether the interrupt is a transmit interrupt or a receive interrupt. If it is a receive interrupt, received data are stored in the receive buffer of FIG. 32A and a serial transfer flag is checked. The serial transfer flag is the flag having been set by the interval timer interrupt of FIG. 38 and is representative of a timing for refreshing serial transfer data to the loads around the transfer drum which have been stated earlier. If the serial transfer flag is not a ONE, the content stored in the transmit buffer of FIG. 32A are transmitted while the parallel data in the receive buffer and the content of the P sensor LED are outputted to the port PA7. If the serial transfer flag is a ONE, the port PC4 is turned to a high level or "H" to switch TxD to the transfer drum side, the serial transmit mode is turned to an I/O interface mode to start serial transfer, and a transmit interrupt is allowed. If the interrupt is a transmit interrupt, it is necessarily an interrupt in the I/O interface mode. Hence, whether or not the data is the last data is determined. If it is not the last data, serial transfer is effected again. If it is the last data, a latch signal fed out via the port PC3 so as to latch a shift register provided at the destination. Thereafter, the program advances to the previously stated transmit routine with the serial transmit mode being turned to an asynchronous mode.

Figure 40:
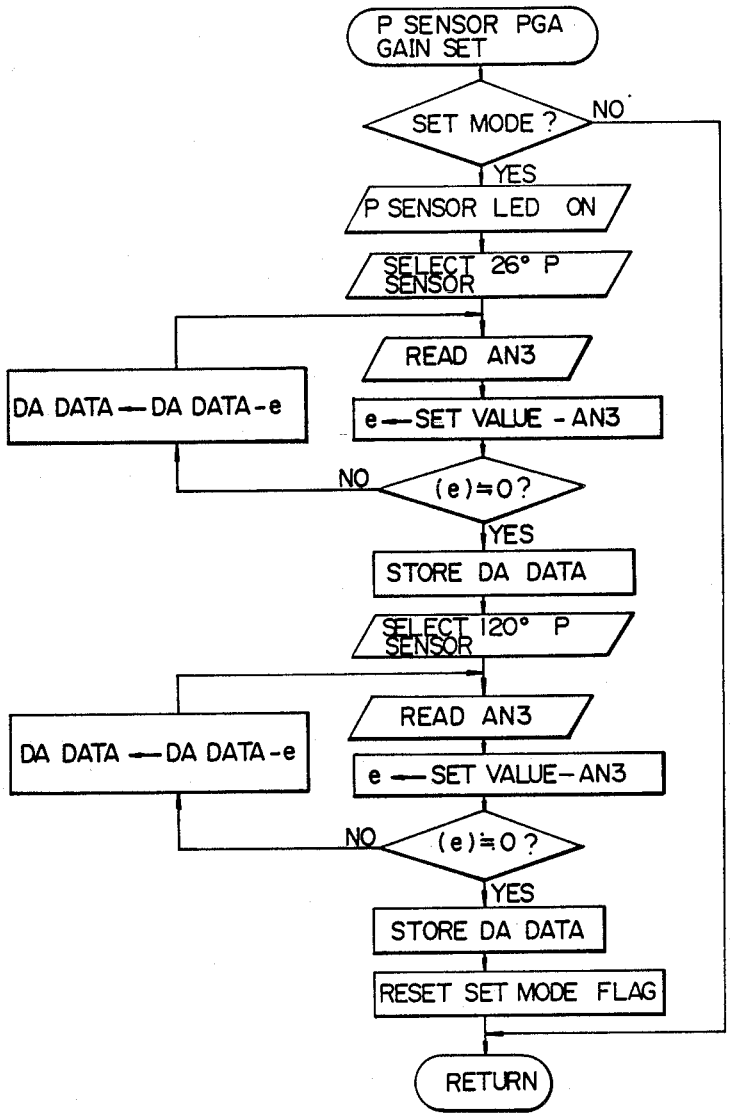

P Sensor PGA Gain Set (FIG. 40)

The gain of the programmable gain amplifier PGA stated earlier is automatically adjusted to a set gain which is fed from the main controller.

Figure 41:
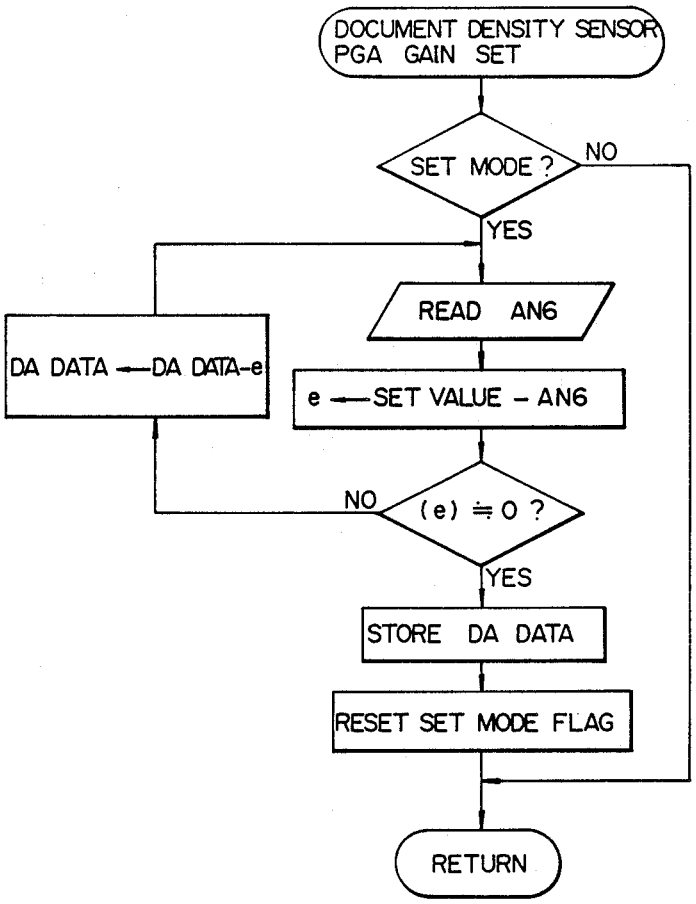

Document Density PGA Gain Set (FIG. 41)

The gain of the programmable gain amplifier PGA stated earlier is automatically adjusted to a set gain which is fed from the main controller.

Figure 42:
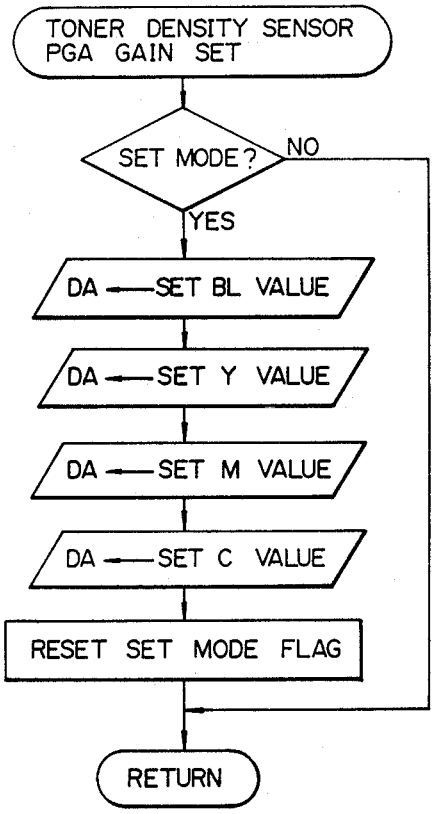

Toner Density PGA Gain Set (FIG. 42)

The gain of the programmable gain amplifier PGA previously mentioned is set at a gain received from the main controller.

In summary, in accordance with the present invention, a bias voltage for developing means is selected on the basis of a ratio of the reflectance $OD_1$ of reference density pattern means and the reflectance $OD_2$ of an actual document surface. More specifically, since the reference density pattern means has a predetermined density, the bais voltage is automatically adjusted in matching relation to the actual document density. Even when density sensing means for reading such densities is implemented by light emitting means which is included in illuminating optics, the ratio of $OD_2$ and $OD_2$ is not effected by the amount of light because the influence of the illuminating level equally appears in $OD_1$ and $OD_2$. Hence, the bias voltage is set in association with the density of a document surface only.

Also, in accordance with the present invention, a target density of a developer stored in developing means is selected in response to a reflectance of a toner image formed on a photoconductive element or similar image carrier and having a relatively high density, i.e., a second recording density $ID_2$. Since a toner image having a relatively high density is produced when the image carrier is substantially not exposed to imagewise light, the density $ID_2$ is free from the influence of the exposing process and determined on the basis of the charge level of charging means and the developer density and bias voltage of the developing means. Nevertheless, the bias voltage is determined in response to the density of a document, as stated above. Hence, if the document density is constant, the bias voltage is constant. It follows that the density $ID_2$ is greatly effected by the toner density of the actually used developer. Specifically, the target developer density is so adjusted as to prevent the density of the actual developer from being noticeably varied. This prevents toner particles from being scattered around due to excessive toner supply. Of course, a change in the voltage of the charging means and the aging of the image carrier effects the density $ID_2$, whereby the target developer density is compensated for, i.e., the developer density is automatically adjusted within a relatively narrow range.

Further, in accordance with the present invention, the amount of light issuing from the illuminating means is adjusted in response to the reflectance of a toner image formed on the image carrier and having a relatively low density, i.e., a first recording density $ID_1$. While the density $ID_1$ is produced by allowing the density of a reference density pattern for the charging, exposing and developing processes, it is considered that the adjustment of bias voltage and that of target developer density as stated above are successful in allowing a minimum of change to occur concerning the charging and developing processes. The density $ID_1$, therefore, reflects the actual amount of light issuing from the illuminating means. For this reason, the conditions associated with the illuminating process and, therefore, the recording density associated with low density portions of an image can be maintained constant by adjusting the amount of illumination on the basis of the density $ID_1$.

Various modifications will become possible for those skilled in the art after receiving the teachings of the present disclosure without departing from the scope thereof.

What is claimed is:

1. An image recording apparatus capable of controlling image density, comprising:

an image carrier;

charging means for charging said image carrier;

illuminating means for illuminating a document laid in an image reading area of a glass platen to electrostatically form a latent image representative of said document on said image carrier;

developing means for developing the latent image formed on said image carrier to produce a visible image;

a reference density pattern having a reference density positioned in close proximity to said image reading area;

read image density sensing means for sensing a density of said reference density pattern and a density of the document;

recorded image density sensing means located to face a surface of said image carrier for sensing an image density of a recorded image having been developed by said developing means; and control means for automatically adjusting an amount of light issuing from said illuminating means in response to a first recorded image density which is sensed by said recorded image density sensing means and associated with an image portion of said reference density pattern having a relatively low density;

said control means automatically adjusting a target value of a density of a developer stored in said developing means in response to a second recorded image density which is sensed by said recorded image density sensing means and associated with a portion of said reference density pattern having a relatively high density;

said control means automatically adjusting a bias voltage to be applied to said developing means in response to a ratio of a first read image density which is sensed by said read image density sensing means and associated with the density of said reference density pattern and a second read image density which is sensed by said read image density sensing means and associated with the density of the document.

2. An apparatus as claimed in claim 1, wherein said developing means comprises developer density sensing means for sensing the density of the developer stored therein;

said developing means automatically adjusting the density of the developer in response to a target density determined by said second recorded image density sensed by said recorded image density sensing means and the density of said developer sensed by said developer density sensing means.

3. An apparatus as claimed in claim 1, wherein said recorded image density sensing means comprises a reflection type photosensor having light emitting means and light receiving means.

4. An apparatus as claimed in claim 3, wherein said photosensor comprises two pairs of sensing means each having said light emitting means and said light receiving means;

said light emitting means and said light receiving means in one of said pairs of sensing means having optical axes which are inclined by a greater angle than optical axes of said light emitting means and said light receiving means in the other pair;

said one sensing means being responsive to said image portion of said reference density pattern having a relatively low density formed on said image carrier;

said other sensing means being responsive to said image portion of said reference density pattern having a relatively high density formed on said image carrier.

* * * * *